US005243732A

United States Patent [19]

Koharagi et al.

[11] Patent Number: 5,243,732

[45] Date of Patent: Sep. 14, 1993

[54] VACUUM CLEANER WITH FUZZY LOGIC CONTROL

[75] Inventors: Haruo Koharagi, Ibaraki; Kazuo Tahara; Toshiyuki Ajima, both of Hitachi; Tsunehiro Endo, Hitachiota; Hisao Suka, Hitachi; Mitsuhisa Kawamata, Hitachi; Fumio Jyoraku, Hitachi; Yoshitaro Ishii, Hitachi; Hisanori Toyoshima, Hitachi; Takeshi Abe, Hitachi; Atusi Hosokawa, Hitachi; Shoichi Ito, Ibaraki; Motoo Futami; Kunio Miyashita, both of Hitachi, all of Japan

[73] Assignee: Hitachi, Ltd., Tokyo, Japan

[21] Appl. No.: 772,549

[22] Filed: Oct. 7, 1991

[30] Foreign Application Priority Data

| | | | |
|---|---|---|---|
| Oct. 5, 1990 | [JP] | Japan | 2-266237 |
| Dec. 3, 1990 | [JP] | Japan | 2-400252 |
| Dec. 3, 1990 | [JP] | Japan | 2-400253 |
| Jan. 29, 1991 | [JP] | Japan | 3-008914 |

[51] Int. Cl.[5] ..... G06F 15/00; A47L 9/00

[52] U.S. Cl. ..... 15/319; 395/900

[58] Field of Search ..... 15/319; 395/900, 61

[56] References Cited

U.S. PATENT DOCUMENTS

| | | | |
|---|---|---|---|
| 4,649,515 | 3/1987 | Thompson et al. | 395/61 |
| 4,654,924 | 4/1987 | Getz et al. | 15/319 |
| 4,733,430 | 3/1988 | Westergren | 15/339 |
| 4,733,431 | 3/1988 | Martin | 15/339 |
| 4,864,490 | 9/1989 | Nomoto et al. | 395/61 |
| 4,880,474 | 11/1989 | Koharagi et al. | 134/21 |
| 4,958,406 | 9/1990 | Toyoshima et al. | 15/319 |

*Primary Examiner*—Allen R. MacDonald

*Attorney, Agent, or Firm*—Antonelli, Terry, Stout & Kraus

[57] ABSTRACT

In a vacuum cleaner, both static pressure $H_{data}$ and a variation width ΔH in the static pressure appearing when a suction port is operated are detected from a pressure sensor provided at a rear side of a filter within a main body of the vacuum cleaner; a current variation width Δpbi appearing when the suction port is operated is detected from a current of a nozzel motor for driving a rotary brush stored in a power brush suction port; an air quantity at the suction port is calculated from the current, rotational speed of a fan motor and static pressure; command values are newly obtained by performing a fuzzy calculation with the variation width Δpbi, static-pressure command value Hcmd; the variation width ΔH and the static-pressure command value Qcmd; the variation width Δpbi and static-pressure command value Hcmd; and also the variation width ΔH and static-pressure command value Qcmd as the input thereto; the rotational speeds of the fan motor and nozzel motor are controlled from the result of the command values; and further optimum air suction force is automatically obtained, depending upon the suction port under use and cleaning floor plane.

16 Claims, 32 Drawing Sheets

RULE 1 : if $x_1$ is $A_{11}$ and $x_2$ is $A_{12}$ then y is $B_1$
RULE 2 : if $x_1$ is $A_{21}$ and $x_2$ is $A_{22}$ then y is $B_2$

FIG. 23

| | | Δpbi (ΔH) | | | | |
|---|---|---|---|---|---|---|
| | | VS Δpbi1 | SL Δpbi2 | MD Δpbi3 | LG Δpbi4 | VL Δpbi5 |
| Q (H) | VS Q1 | ZO | PS | PS | PM | PM |
| | SL Q2 | NS | ZO | PS | PM | PB |
| | MD Q3 | NM | NS | ZO | PS | PM |
| | LG Q4 | NB | NM | NS | ZO | PS |
| | VL Q5 | NB | NB | NM | NS | ZO |

NB = NEGATIVE BIG
NM = NEGATIVE MEDIUM
NS = NEGATIVE SMALL
ZO = ZERO
PS = POSITIVE SMALL
PM = POSITIVE MEDIUM
PB = POSITIVE BIG

VACUUM CLEANER WITH FUZZY LOGIC CONTROL

BACKGROUND OF THE INVENTION

The present invention generally relates to a vacuum cleaner and a method of control thereof. More specifically, the present invention relates to a vacuum cleaner using a power brush suction port provided with a rotary brush, which vacuum cleaner is operated under an optimum state according to a control method which depends upon a characteristic of the floor surface to be cleaned and the suction port under use.

In the conventional vacuum cleaner, as described in JP-A-64-52430, the sorts of surface to be cleaned are sensed from a variation in a current flowing through the nozzle motor mounted on the air suction port, and the input to the fan motor is controlled based on this result.

According to the above-described vacuum cleaner, the current flowing through the nozzle motor mounted on the suction port will vary depending upon the operators using the vacuum cleaner. Thus, there is a problem in such a method for sensing the sorts of floor surfaces in response to the current values in that the sorts of floor may be mistakenly judged.

As a conventional vacuum cleaner, another type of vacuum cleaner has been described in JP-A-63-309232, in which, when the value of the current flowing through the nozzle motor provided at the suction port exceeds a certain setting value for more than a certain setting time period, the supply to the nozzle motor is turned OFF.

In the conventional techniques, since the current flowing through the nozzle motor provided at the suction port will vary depending upon the operators using the vacuum cleaner, and also the magnitudes thereof may vary depending upon the sorts of cleaning surfaces, there are many possibilities to judge that the rotary brush is locked, depending upon the current setting value and the setting time period. Conversely, if the values of the current setting value and setting time period are set too large, there is another problem in that the motor may be damaged.

Furthermore, there has been disclosed a conventional method in JP-A-63-65835, in which the suction force of the vacuum cleaner is sensed by a sensor in order that the vacuum cleaner may be automatically operated so as to improve operabilities thereof and save power consumption. However, as objects to be sensed by this sensor are the static pressure within the main body of the vacuum cleaner and the air capacity, it is difficult to properly judge the conditions of the cleaning surfaces based upon only this sensed object. Also in the automatic control operation, the shapes of the suction characteristic diagram represented by the static pressure and air quantity are adjusted and the vacuum cleaner is operated in accordance with the determined static pressure/air quantity characteristic. Accordingly, it is rather difficult to control the vacuum cleaner at the optimum state, depending upon the sorts of cleaning surfaces and also suction ports, as well as the states of use of the vacuum cleaner.

In another conventional vacuum cleaner, the AC commutator motor is employed as the driving source and a triac is combined with the pressure sensor or air quantity (capacity) sensor; the voltage applied to the AC commutator motor is controlled or adjusted by way of the triac; and then the power to the vacuum cleaner is controlled, depending upon the surfaces to be cleaned, or the pressure sensor or air quantity sensor.

In this conventional vacuum cleaner, the various factors indicative of the load conditions of the fan motor, namely the air quantity are directly sensed by the air-quantity sensor, otherwise the relationship between the static pressure and air capacity has been previously stored as the memory table, whereby the static pressures are sensed from the output from the pressure sensor in order to control the rotational speed. As a consequence, there are such problems that higher cost is required to mount the pressure sensor and a large volume is required in the former case, and furthermore, if the air quantity is required at high precision over a wide range, a huge amount of table data is necessarily required.

SUMMARY OF THE INVENTION

An object of the present invention is to provide a vacuum cleaner and a control method thereof, capable of automatically obtaining optimum suction force in accordance with either a floor surface and an air suction port under use, or an operation condition of the vacuum cleaner.

That is to say, it is an object to correctly sense an air suction port under use and also automatically control a rotation speed of a far motor in accordance with a degree of a choking phenomenon occurring in a filter.

It is also an object to judge whether or not the suction port is manipulated by way of a pressure sensor provided within a main body of the vacuum cleaner, so that the operation state is classified by a control for using a power brush, and another control for using an air suction port other than the power brush, and also the fan motor is properly controlled, depending upon operations of the suction ports and sorts of the cleaning surfaces.

A further object of the present invention is to provide a vacuum cleaner and a control method thereof, capable of automatically obtaining optimum suction force, depending upon the sorts of cleaning surfaces and suction ports under use, even when the rotary brush is locked.

Another object of the present invention is to provide a vacuum cleaner capable of correctly judging a locking state of a rotary brush and of protecting the nozzle motor.

Another object of the present invention is to provide a vacuum cleaner capable of protecting the fan motor when a suction port is tightly closed, the power source is interrupted, or the power supply voltage is varied.

Another object of the present invention is to provide a vacuum cleaner capable of specifying a malfunction when the vacuum cleaner is brought into an extraordinary state.

A still further object of the present invention is to provide a vacuum cleaner including a control unit for the fan motor, capable of sensing an air quantity corresponding to a factor indicative of load conditions without employing an air quantity sensor, and also capable of operating the vacuum cleaner in an optimum state in response to the sensed air quantity.

To achieve this object, a vacuum cleaner, according to the present invention, comprises:

a filter for collecting dust;

a variable-speed fan motor for applying suction force to the vacuum cleaner;

a pressure sensor for sensing a choking phenomenon of said filter, which is disposed within a main body case of the vacuum cleaner;

a sensor for sensing a rotational speed of the fan motor;

a sensor for sensing a load current of the fan motor;

a circuit for detecting a current of a nozzle motor to drive a rotary brush, which is stored in an air suction port of a power brush; and, control means for detecting static pressure at an output of said pressure sensor, for calculating an air quantity flowing from said air suction port with employment of the rotational speed and load current of the fan motor sensed by said rotational speed sensor and said current sensor, or the rotational speed load current of the fan motor and said static pressure, and for controlling the rotational speed of said fan motor based upon an air-quantity command value, a static pressure command value related to the air quantity and static pressure at said air suction port, and said static pressure detection value and said air-quantity calculation value, said control means detecting a variation width of a peak value of a current of said nozzle motor and a variation width of said static pressure which vary depending upon operation of said suction port during a cleaning operation, performing a fuzzy calculation with at least two inputs among said air-quantity command value, said static-pressure command value, said variation width of the peak value of the current of said nozzle motor and said variation width of the static pressure, and further determining said air-quantity command value and static-pressure command value based on a result of said fuzzy calculation.

Furthermore, a vacuum cleaner, according to the present invention, comprises:

a filter for collecting dust;

a variable-speed fan motor for applying suction force to the vacuum cleaner;

a pressure sensor for sensing a choking phenomenon of said filter, which is disposed within a main body case of the vacuum cleaner;

a sensor for sensing a rotational speed of the fan motor;

a sensor for sensing a load current of the fan motor;

a circuit for detecting a current of a nozzle motor to drive a rotary brush, which is stored in an air suction port of a power brush; and, control means for detecting static pressure at an output of said pressure sensor, for calculating an air quantity flowing from said air suction port with employment of the rotational speed and load current of the fan motor sensed by said rotational speed sensor and said current sensor, or the rotational speed load current of the fan motor and said static pressure, and for controlling the rotational speed of said fan motor based upon an air-quantity command value, a static-pressure command value which are related to the air quantity and static pressure at said air suction port, and said static pressure detection value and said air-quantity calculation value, said control means detecting a variation width of a peak value of a current of said nozzle motor and a variation width of said static pressure which vary depending upon operation of said suction port during a cleaning operation, performing a fuzzy calculation with at least two inputs among said air-quantity command value, said static-pressure command value, said variation width of the peak value, said variation width of the peak value of the current of said nozzle motor and said variation width of the static pressure, determining said air-quantity command value and static-pressure command value based on a result of said fuzzy calculation, detecting a locking state of said rotary brush from the current value of said nozzle motor; and further employing a result of the fizzy calculation with said variation of the static pressure as the input.

Also, a vacuum cleaner, according to the present invention, comprises: a filter for collecting dust; a variable-speed fan motor for applying suction force to the vacuum cleaner; a pressure sensor for sensing a choking phenomenon of said filter, which is disposed within a main body case of the vacuum cleaner; and a circuit for detecting a current of a nozzle motor to drive a rotary brush, which is stored in an air suction port of a power brush, wherein:

a judgement is made that said air suction port is tightly closed, based on a magnitude of a load current of said fan motor while being rotated at a constant speed, and also the operation of said fan motor is stopped based on the judgement result.

Then, a vacuum cleaner, according to the present invention, comprises: a filter for collecting dust; a variable-speed fan motor for applying suction force to the vacuum cleaner; a pressure sensor for sensing a choking phenomenon of said filter, which is disposed within a main body case of the vacuum cleaner; and, a circuit for detecting a current of a nozzle motor to drive a rotary brush, which is stored in an air suction port of a power brush, wherein:

whether or not there is an AC current corresponding to a power source of said vacuum cleaner, is detected by a zerocross detecting circuit;

when the power source is instantaneously interrupted due to no zerocross, a speed command of said fan motor is lowered; and, when the time period during which there is no zerocross exceeds a certain setting time period, the operation of said fan motor is stopped.

Then, a vacuum cleaner, according to the present invention, comprises: a filter for collecting dust; a variable-speed fan motor for applying suction force to the vacuum cleaner; a pressure sensor for sensing a choking phenomenon of said filter, which is disposed within a main body case of the vacuum cleaner; and, a circuit for detecting a current of a nozzle motor to drive a rotary brush, which is stored in an air suction port of a power brush, wherein:

a duty ratio of 100% being a voltage control is detected from an PWM pulse of a power converting element for supplying power to said fan motor, and a speed command of said fan motor is corrected based on a result of said duty ratio of 100% detection Furthermore, a vacuum cleaner, according to the present invention, comprises: a filter for collecting dust; a variable-speed fan motor for applying suction force to the vacuum cleaner; a pressure sensor for sensing a choking phenomenon of said filter, which is disposed within a main body case of the vacuum cleaner; and, a circuit for detecting a current of a nozzle motor to drive a rotary brush, which is stored in an air suction port of a power brush, wherein:

a self-diagnostic operation switch for checking whether or not a malfunction of an overall system of said vacuum cleaner happens to occur, as an operation switch of said vacuum cleaner;

when said self-diagnostic operation switch is turned ON, said fan motor is rotated at a constant speed;

an output of a temperature sensor provided within a main body of the vacuum cleaner is detected by executing a temperature detecting process with a temperature detecting circuit;

an output from said pressure sensor is detected by executing a static-pressure detecting process with a static pressure detecting circuit;

a current of said nozzle motor is detected by executing a nozzle-motor-current detecting process with employment of a nozzle-motor-current detecting circuit; and, the malfunction part of the system is judged from the detection results and said detection results are displayed on a display circuit provided on the main body of the vacuum cleaner.

Also, a vacuum cleaner, according to the present invention, comprises: a filter for collecting dust; a variable-speed fan motor for applying suction force to the vacuum cleaner; a pressure sensor for sensing a choking phenomenon of said filter, which is disposed within a main body case of the vacuum cleaner; and a circuit for detecting a current of a nozzle motor to drive a rotary brush, which is stored in an air suction port of a power brush, wherein:

a self-diagnostic operation switch for checking whether or not a malfunction of an overall system of said vacuum cleaner happens to occur, as an operation switch of said vacuum cleaner;

when said self-diagnostic operation switch is turned ON, said brushless fan motor is driven at a constant rotational speed and under synchronization start;

an output of a temperature sensor provided within a main body of the vacuum cleaner is detected by executing a temperature detecting process with a temperature detecting circuit;

an output from said pressure sensor is detected by executing a static-pressure detecting process with a static pressure detecting circuit;

a current of said nozzle motor is detected by executing a nozzle-motor-current detecting process with employment of a nozzle motor current detecting circuit;

a current of said brushless fan motor is detected by executing a fan motor-current detecting process with a fan-motor-current detecting circuit;

a magnetic pole position of a rotor of said brushless fan motor is detected via a magnetic pole position detecting circuit; and, the malfunction part of the system is judged from the detection results and said detection results are displayed on a display circuit provided on the main body of the vacuum cleaner.

Moreover, a vacuum cleaner, according to the present invention, comprises:

a main body including a variable speed fan motor for applying air suction force to the vacuum cleaner;

a hose connected to said main body;

a suction port;

an extension wand connected to said suction port;

a pressure sensor provided within said main body; and, control means used to a fan motor, for judging whether or not said suction port is under use condition based on variations in an output from said pressure sensor, and for selecting one of a waiting operation and a normal operation as an operation state of said fan motor.

Furthermore, a vacuum cleaner, according to the present invention, comprises:

a filter for collecting dust;

a variable speed fan motor for generating dust suction force;

a static pressure sensor for detecting pressure of the vacuum cleaner; and, a control unit for calculating an air quantity as one of various factors indicative of load conditions of said vacuum cleaner based on a current command (load current) of said fan motor, a speed command (rotational speed) and an output result from said pressure sensor, and for determining the speed command of said fan motor based upon the calculation result of the air quantity.

To achieve the above-described objects, a method for controlling a vacuum cleaner, according to the present invention, includes a filter for collecting dust; a variable speed fan motor for applying air suction force to the vacuum cleaner; a pressure censor provided within a main body case of the vacuum cleaner, for sensing a choking phenomenon of the filter; a circuit for detecting a current of a nozzle motor for driving a rotary brush stored in a power brush; and a control circuit for the fan motor, comprising the steps of:

detecting static pressure at an output from said pressure sensor, and calculating an air quantity flowing from said air suction port with employment of a rotation speed and a load current of said fan motor, or the rotation speed, load current of the fan motor and said static pressure;

detecting a variation width of the peak current value of said nozzle motor and a variation width of the static pressure which are varied depending upon operation of said suction port during a cleaning operation, executing a fuzzy calculation with at least two inputs among said air-quantity command value, said static-pressure command value, said variation width of the peak current value of said nozzle motor and also said variation width of the static pressure; and determining said air-quantity command value and said static-pressure command value based upon the result of said fuzzy calculation; and, controlling the rotational speed of said fan motor in accordance with the air-quantity command value and the static-pressure command value which are related to the air quantity and static pressure at said air suction port, and also said static pressure detection value and said air-quantity calculation value.

Further, a method for controlling a vacuum cleaner, according to the present invention, includes a filter for collecting dust; a variable speed fan motor for applying air suction force to the vacuum cleaner; a pressure sensor provided within a main body case of the vacuum cleaner, for sensing a choking phenomenon of the filter; a circuit for detecting a current of a nozzle motor for driving a rotary brush stored in a power brush; and a control circuit for a rotational speed of the fan motor, comprising the steps of:

rotating said fan motor at a low rotational speed as a waiting operation by firstly executing an initiation process of said fan motor upon turning ON an operation switch of said vacuum cleaner; detecting operation conditions of said suction port from changes in the output from said pressure sensor; increasing power to said fan motor so as to be brought into a cleaning condition by the vacuum cleaner under the operation state of said suction port; detecting static pressure from the output of said pressure sensor; and also calculating an air quantity flown from said air suction port with employment of the rotational speed and the load current of said fan motor, or the rotational speed, load current of the fan motor and static pressure;

controlling the rotational speed of the fan motor, depending upon the air-quantity command value and static-pressure command value which are related to the air quantity and static pressure at said suction port, and also said static pressure detection value and said air quantity calculation value;

detecting a variation width of the peak current value of said nozzle motor and a variation width of the static pressure which are varied depending upon operation of said suction port during a cleaning operation, executing a fuzzy calculation with at least two inputs among said air-quantity command value, said static-pressure command value, said variation width of the peak current value of said nozzle motor and also said variation width of the static pressure; and determining said air-quantity command value and said static-pressure command value based upon the result of said fuzzy calculation.

And, moreover, a method for controlling a vacuum cleaner, according to the present invention, includes a filter for collecting dust; a fan motor for applying air suction force to the vacuum cleaner; a power brush suction port including a nozzle motor to drive a rotary brush at an air intake port; and a phase control circuit for controlling a voltage applied to the nozzle motor, wherein:

a current detecting circuit for detecting a load current of said nozzle motor is provided;

when an output from said current detecting circuit exceeds a first setting value, a phase control angle of said nozzle motor is controlled to reduce the apply voltage thereof; and, when the output from said current detecting circuit exceeds a second setting value, it is judged that said rotary brush is locked and operation of said nozzle motor is stopped.

In the vacuum cleaner according to the present invention, since the rotary brush is directly in contact with the floor surface, variations occur in the current of the nozzle motor for driving the rotary brush during the cleaning operation, the variation width Δpbi of the peak current value of the nozzle motor is changed in response to depression force against the suction port and sorts of the floor surfaces, and then the variation width ΔH of the static pressure is varied depending upon the sorts of the cleaning floor surfaces and the depression force against the suction port when the suction port without the rotary brush is employed. These variation width Δpbi, width ΔH, air-quantity command value Qcmd and static pressure command value Hcmd are used as inputs so as to execute the fuzzy calculation. The results are integrated thereby to newly produce an air-quantity command value Q and a static-pressure command value Hcmd. Then, since the rotational speed of the fan motor is so controlled that this result, the static-pressure detection value H data and the air-quantity calculation value Q data are coincident with each other, the suction force can be freely controlled and therefore the vacuum cleaner capable of cleaning the floor surfaces with the optimum suction force is obtained, depending upon the sorts of cleaning floor surfaces, the suction port under use, and also the operation states of the suction ports used by various operators.

Furthermore, in the vacuum cleaner according to the present invention, since the rotary brush is directly in contact with the floor surface, there are changes in the current of the nozzle motor for driving the rotary brush during the cleaning operation, Then, as the peak value of the currents flowing through the nozzle motor are different from each other, depending upon the persons who operate the suction port and also the floor surfaces to be cleaned, when the peak current values continuously exceed the first setting value for more than the first setting time period, it seems that the rotary brush is locked and therefore the phase control angle of the nozzle motor is controlled so as to lower the supply voltage. As a result, the current flowing through the nozzle motor becomes small and thus damages to the components around the commutator nay be prevented. Furthermore, when the output from the current detecting circuit continuously exceeds the second setting value for more than a second setting time period, it can be newly judged that the rotary brush is locked, and then the operation of the nozzle motor is stopped, whereby the locking state of the rotary brush can be correctly judged without impairing the operabilities of the vacuum cleaner and further the nozzle motor can be protected from damages. Next, in case the rotary brush is locked while controlling the rotational speed of the fan motor based upon the calculation results of the fuzzy calculation with the variation width Δpbi of the current of the nozzle motor which is varied in accordance with the sorts of surfaces being cleaned during the cleaning operation, the control mode is automatically selected in such a manner that the rotational speed of the fan motor is controlled in response to the fuzzy calculation with the static-pressure variation width ΔH as the input data. Accordingly, the operabilities of the vacuum cleaner can be improved. Subsequently, although the air quantity becomes zero when the suction port is tightly closed and also the cooling air quantity of the fan motor becomes zero under such a condition, the motor is rotated at a constant speed and the operation of the fan motor is stopped in case that the magnitudes of the load current of the motor is continuously smaller than a certain set value at this time. As a consequence, the fan motor can be thermally protected. Furthermore, with respect to either the instantaneous interruption of the power source, or the voltage variations under which the motor becomes uncontrol states, whether or not the AC current appears is detected by the zerocross detecting circuit, the duty ratio of 100% produced from the voltage drop is detected by the duty detecting circuit and then the speed command is so corrected as to not the bring the fan motor into uncontrolled states. Therefore, no overcurrent flows through the motor even when the power supply has recovered and the voltage is rapidly increased, and the fan motor can be protected in view of the motor currents. Then, since both the waiting operation condition and the operation condition capable of cleaning the floor surfaces are provided in accordance with the operation conditions of the vacuum cleaner, the power consumption is lowered during a no cleaning operation, resulting in saving energy and reducing noise, whereas high power can be obtained and the required air suction force can be obtained during the cleaning operation, resulting in improved operation of the vacuum cleaner. Next, the self-diagnostic operation mode is employed in order that, when the vacuum cleaner is suddenly stopped for extraordinary reasons, this malfunction can be specified. Thus, it is possible to realize a vacuum cleaner with minimum troubles to the users.

In accordance with the present invention, there are provided as the sensors for grasping the operation conditions of the vacuum cleaner, a pressure sensor for detecting static pressure within the main body of the vacuum cleaner; a current sensor for detecting the current of the motor to drive the rotary brush, which has been built in the suction port; and various sensors for detecting the rotation number and currents of the motor employed in the main body of the vacuum cleaner.

First, attention is paid to the fact that it is possible to judge whether or not the suction port is manipulated, based upon the variations in the detection values of the pressure sensor (namely, the suction port is mutually moved with respect to the cleaning surface). When the suction port is not manipulated, the operation mode is set to reduce the suction force under the waiting operation condition, whereby noise is reduced and power consumption is lowered.

Next, when such a judgement result is established that the variation in values of the pressure sensor are detected and the suction port is under use, the operation mode is entered into the automatic control operation. In this case, by way of the current detecting sensor for the motor to drive the rotary brush, discrimination can be performed between the so-called "power brush" connected to the suction port, and the suction port other than this power brush connected thereto. Also, the optimum control operations can be automatically selected with regard to the respective cases.

While using the power brush, such an automatic control operation is performed that the current value of the motor (nozzle motor) for driving the rotary brush is utilized as the input information, whereas while using the suction port other than the power brush, such an automatic control operation is carried out that the detection value of the pressure sensor is utilized as the input information. According to the present invention, it is possible to realize the automatic control operations suitable for the various cleaning surfaces and various suction ports.

Furthermore, in accordance with the present invention, since the air capacity is calculated from the load current and rotational speed of the fan motor, and then the speed command for the fan motor is determined based upon the calculated air quantity, the optimum suction force depending upon the load conditions can be obtained without employing the air quantity sensor.

BRIEF DESCRIPTION OF THE DRAWINGS

These and other objects and advantages of the present invention will become apparent by reference to the following description and accompanying drawings, wherein:

FIGS. 7A, 7B and 7C are representations for explaining a detection of a nozzle motor current, wherein FIG. 7A is a circuit arrangement of detecting the nozzle motor current, and FIGS. 7B, 7C represent examples of outputs thereof;

FIGS. 20A and 20B represent changes in static pressure during idle operation and FUZZY control operation, wherein FIG. 20A shows changes in static pressure during the idle operation and FIG. 20B indicates changes in static pressure during the FUZZY control operation;

FIG. 23 is a diagram for showing a Fuzzy rule applied to the vacuum cleaner according to the preferred embodiment of the present invention;

DESCRIPTION OF THE PREFERRED EMBODIMENTS

Referring now to FIGS. 1 to 25A and 25B, one preferred embodiment of the present invention will be described. It should be noted that in accordance with the present invention, a variable speed motor is used as a fan motor functioning as a drive source of a vacuum cleaner. As the variable speed motor, one may use an AC commutator motor; a phase control motor; an inverter drive type induction motor; a reluctance motor; and a brushless motor. In this preferred embodiment, a brushless motor is employed as the fan motor, which has no mechanically slidable brush, and so has a long lifetime and provides a better control response characteristic.

According to the present invention, there is basically employed a nozzle motor for driving a rotary brush in a suction port. As this nozzle motor, a DC magnet motor and an AC commutator motor may be employed. In accordance with this preferred embodiment, a DC magnet motor having a commutating circuit is employed as this nozzle motor. A description will now be made of an example in which both a pressure sensor (semiconductor pressure sensor) for detecting a choking phenomenon of a filter, and a temperature sensor (thermistor and the like) for protecting overheat of the fan motor or control circuit are employed in the main body of the vacuum cleaner.

Figure 1A:
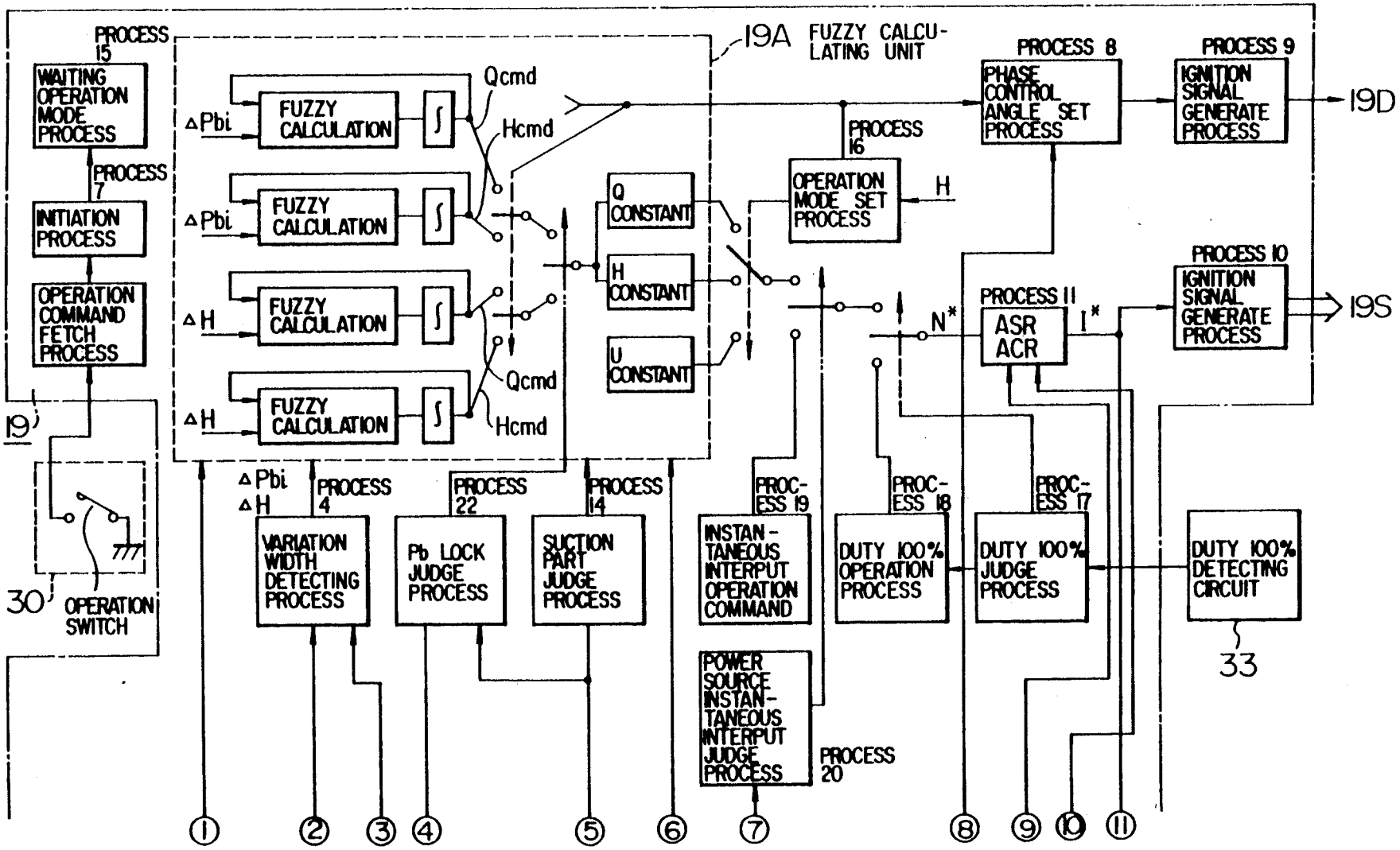
FIGS. 1A and 1B in combination provide a schematic block diagram showing an arrangement of a control circuit for a vacuum cleaner according to a preferred embodiment of the present invention.
Figure 1B:
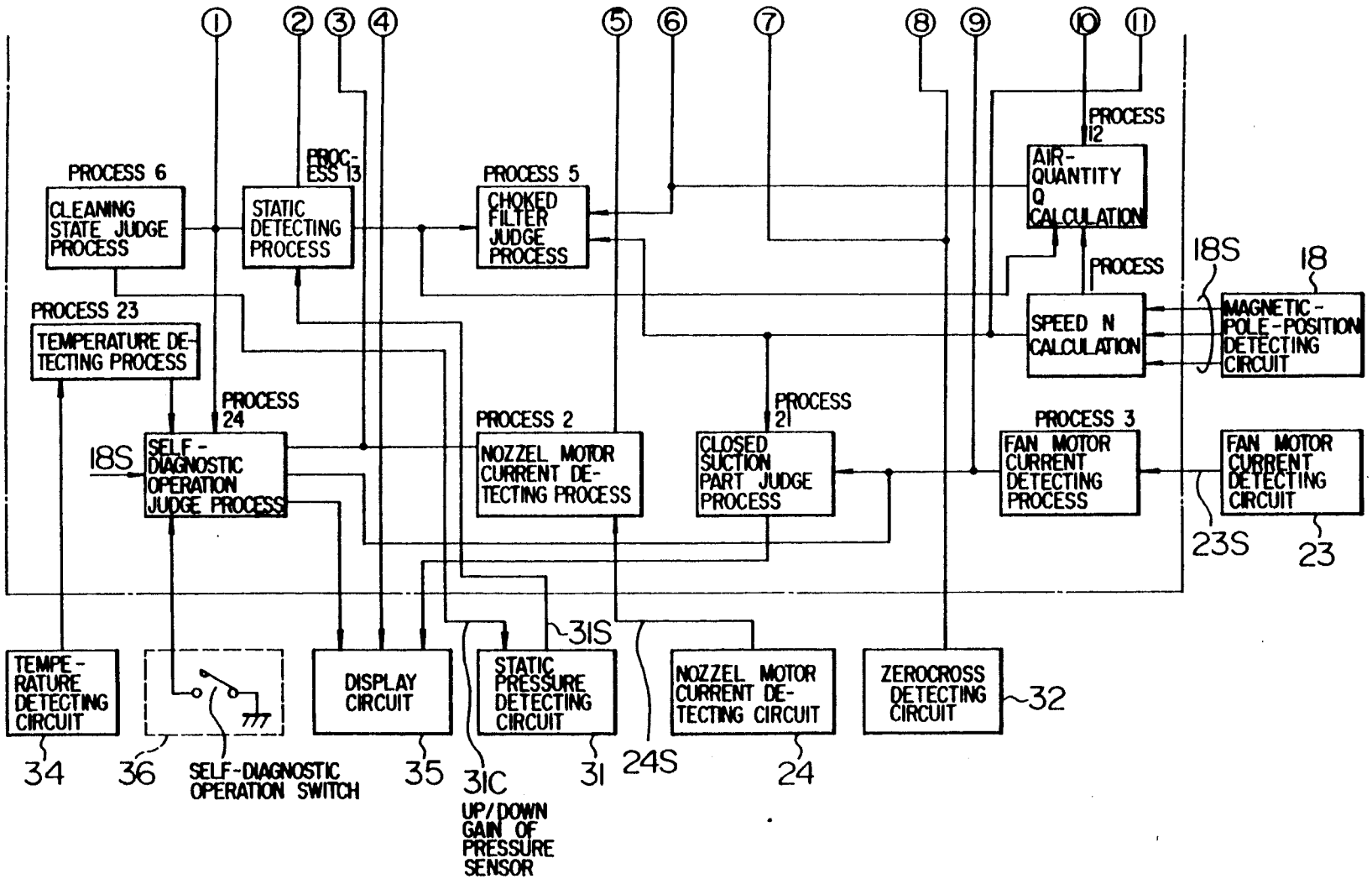
Figure 2:
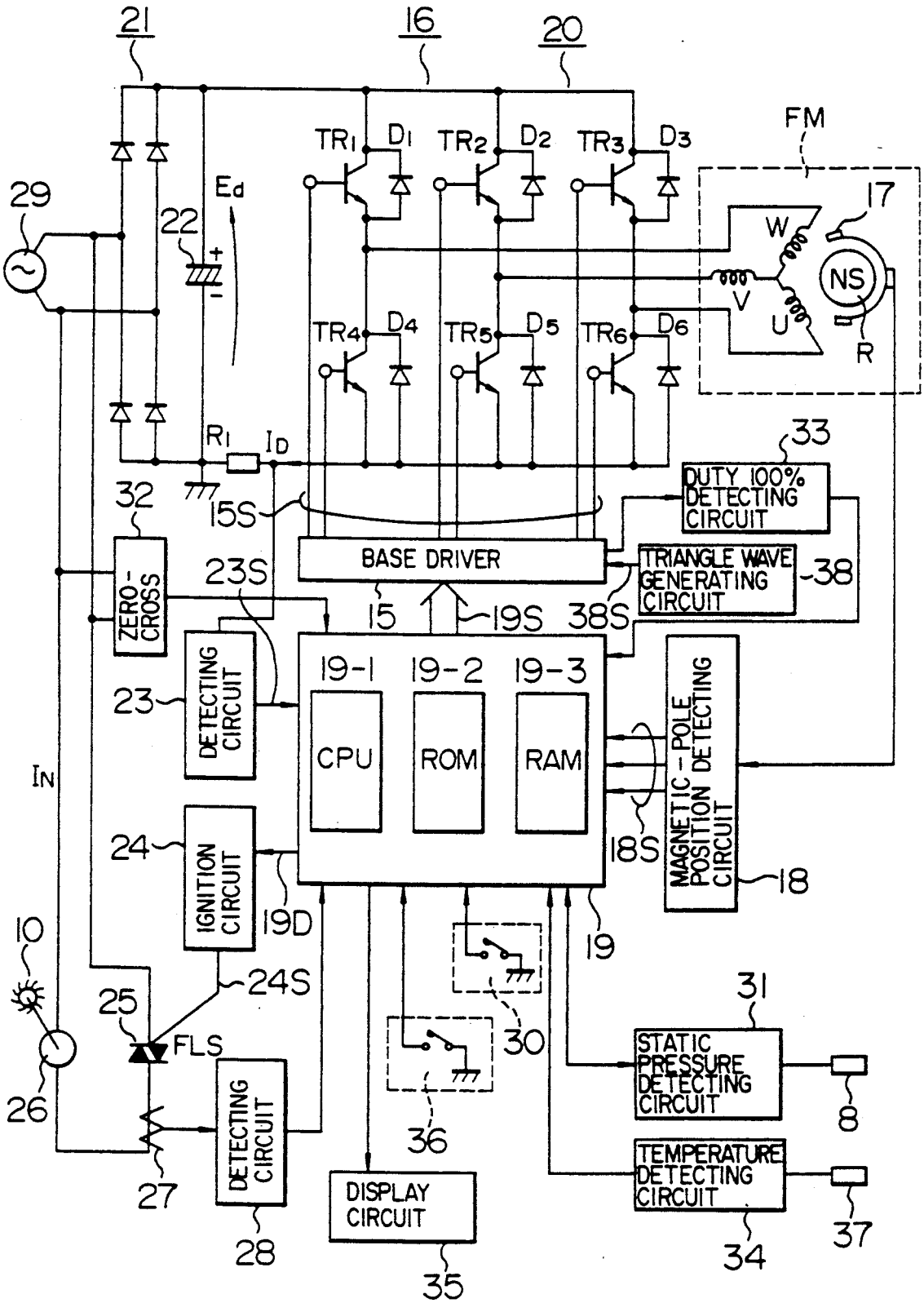
FIG. 2 shows an overall arrangement of the control circuit represented in FIG. 1.

FIG. 1 is a block diagram representing an arrangement of the control circuit. FIG. 2 shows an entire arrangement of the control circuit.

In the drawing, reference numeral 16 indicates an inverter control apparatus. Reference numeral 29 denotes an AC (alternating current) power supply. An AC voltage of this AC power supply 29 is rectified by a rectifier circuit 21 and is smoothened by a capacitor 22, so that a DC voltage "Ed" is applied to an inverter circuit 20. The inverter circuit 20 is a 120-degree conduction type inverter constructed of transistors $TR_1$ to $TR_6$ and circulating diodes $D_1$ to $D_6$ which are connected in parallel to these transistor $TR_1$ to $TR_6$. The transistors $TR_1$ to $TR_3$ constitute a positive arm, whereas the transistors $TR_4$ to $TR_6$ constitute a negative arm. The conduction period of the respective arms is 120 degree in electric angle. The transistors $TR_1$ to $TR_6$ are pulse-width-modulated (PWM) in accordance with a triangle wave generating circuit 38. Symbol "$R_1$" indicates a resistor having a relatively low resistance, and connected between emitter sides of the transistors $TR_4$ to $TR_6$ for constituting the negative arm and a minus side of a capacitor 22.

Symbol "FM" indicates a brushless motor functioning as a fan driving motor (will be referred to as a "fan motor") and having a rotor "R" constructed of two-pole permanent magnets, and armature wires "U", "V" and "W". A load current "$I_D$" flowing through the respective wires U, V and W may be detected as a voltage drop of the above-described resistor "$R_1$". A speed control circuit of the fan motor "FM" is mainly constructed of a magnetic-pole-position detecting circuit 18 for detecting a magnetic pole position of the rotor R by means of a Hall-effect element 17 and the like; a fan-motor-current detecting circuit 23 for detecting and amplifying the load current $I_D$; a base driver 15 for driving the transistors $TR_1$ to $TR_6$; and also a microcomputer 19 for driving the base driver 15 in response to a detection signal 18S obtained from the detecting circuit 18. Reference numeral 30 indicates an operation switch actually operated by an operator. Reference numeral 36 represents a self-diagnostic operation switch manipulated by a servicemen.

On the other hand, reference numeral 26 indicates a nozzle motor for driving the rotary brush 10 provided at a suction port side of the vacuum cleaner. Power is supplied to the nozzle motor by phase-controlling an AC power supply 29 with a triac (FLS) 25. Reference numeral 24 denotes an ignition circuit of the triac 25 which outputs an ignition signal 24S. Reference numeral 27 represents a current detector of a load current $I_N$ flowing through the nozzle motor 26. Reference numeral 28 denotes a nozzle-motor-current detecting circuit for detecting an output signal from the current detector 27 and for amplifying the detected output signal.

In response to a signal from the Hall-effect element 17, the magnetic-pole-position detecting circuit 18 produces the magnetic-pole-position signal 18S of the rotor R. This magnetic-pole-position signal 18S is employed not only to change currents flowing through the armature wires U, V, W (commutation), but also as a signal to detect a rotational speed. The microcomputer 19 operates to obtain the speed or velocity by counting the number of the magnetic-pole position signals within a constant sampling period.

The detecting circuit 23 for detecting the load-current $I_D$ of the fan motor FM, obtains this load current $I_D$ by converting the voltage-drop of the resistor R, into a DC component by a peak hold circuit (not shown) and also by amplifying the DC component, since the output signal of the current detecting circuit 27 is an AC signal.

The detecting circuit 28 for the load current $I_N$ of the nozzle motor 26 (including the rectifier circuit) obtains the load current $I_N$ of the nozzle motor 26 by rectifying the output signal of the current detector 27 to obtain a DC component thereof and by amplifying this DC component.

The microcomputer 19 includes a central processing unit (CPU) 19-1, a read-only memory (ROM) 19-2, and a random access memory (RAM) 19-3. These components are mutually connected with each other by way of an address bus and a control bus (both of these buses are not shown). There has been stored in ROM 19-2, a program required to drive the fan motor FM, for instance, a velocity calculating process, a speed controlling process (ASR), a current controlling process (ACR), a current detecting process for the nozzle motor, a current detecting process and a static-pressure detecting process for the fan motor RAM 19-3 is employed so as to read/write various external data required while the various programs stored in ROM 19-2 are executed.

The transistor $TR_1$ to $TR_6$ are driven by the base drivers 15 in response to the ignition signals 19S produced and processed by the microcomputer.

The triac 25 is driven by the ignition circuit 24 in response to the ignition signal 19D which has been similarly processed and generated by the microcomputer 19 based upon the zerocross detecting circuit 32 of the AC power supply 29.

The static pressure detecting circuit 31 converts an output from the pressure sensor 8 positioned in the air flow station in the main body of the vacuum cleaner into a value of static pressure, and determines a conversion gain in response to the signal from the microcomputer 19. The temperature detecting circuit 34 detects operation temperature of either the fan motor 17 or the inverter control apparatus 16 by the temperature sensor 37 provided within the main body of the vacuum cleaner.

The duty 100% detecting circuit 33 detects that the transistors $TR_1$ to $TR_6$ have not been chopped in response to the ignition signal 15S which has been pulse-width-modulated by comparing the triangle wave signal 38S with the ignition signal 19D that is the current changing signal (commutation signal) for each of the armature wires U, V, W, of the fan motor FM. Reference numeral 35 indicates a display circuit representative of the drive conditions of the fan motor FM driven by the inverter control apparatus 16.

Since the currents flowing through the armature wires corresponds to output torque of the brushless fan motor FM, the output torque thereof may be varied if the supply current to this motor is conversely changed. That is, the output of the brushless motor may be continuously and arbitrarily changed by adjusting the supply current. Also, the rotational speed or velocity of the fan motor FM may be freely changed by varying the drive frequency of the inverter.

It should be noted that the vacuum cleaner according to the present invention is to employ such a brushless motor.

Figure 3:
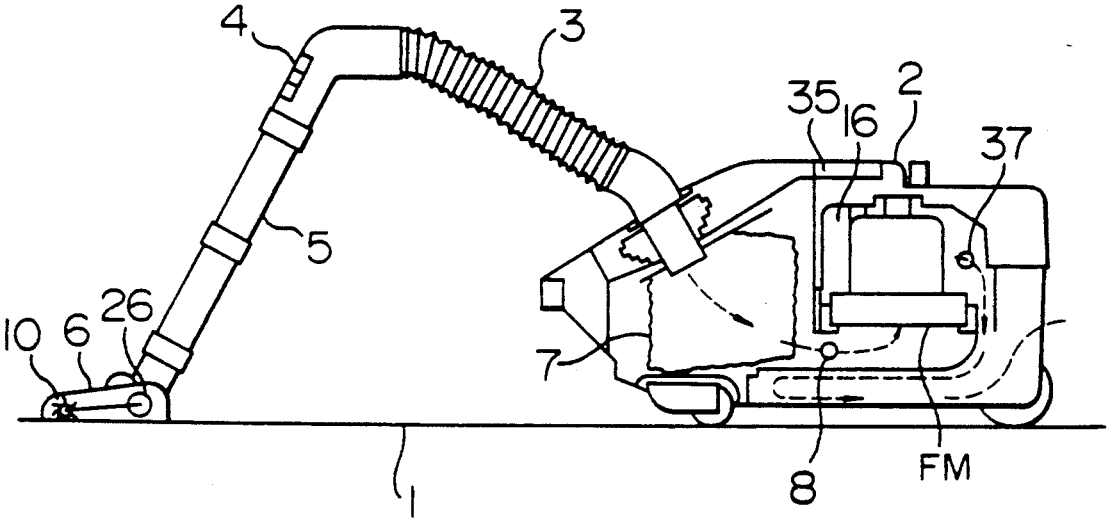
FIG. 3 represents an entire construction of the vacuum cleaner.
Figure 4:
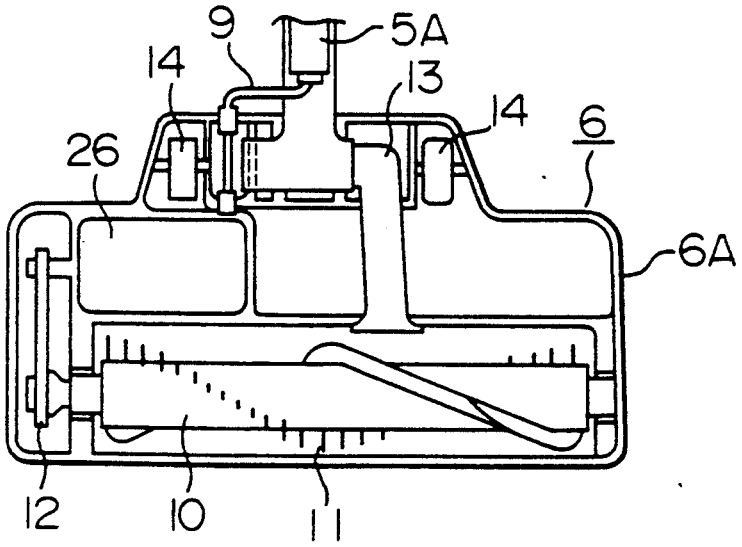
FIG. 4 illustrates an internal construction of a power brush intake port of the vacuum cleaner shown in FIG. 3.

Next, FIG. 3 represents an entire construction of the vacuum cleaner, and FIG. 4 indicates an internal construction of a power brush suction port.

In FIGS. 3 and 4, reference numeral 2 indicates a floor surface or plane to be cleaned (cleaning floor surface); reference numeral 2 denotes a main body of the vacuum cleaner; reference numeral 3 represents a hose; reference numeral 4 indicates a handle switch unit; reference numeral 5 denotes a extension wand; and reference numeral 6 indicates a power brush suction port including the nozzle motor for driving the rotary brush 10. Reference numeral 7 indicates a filter; reference numeral 8 represents a pressure sensor (semiconductor pressure sensor) for detecting a choking degree of the filter 7; reference numeral 37 indicates a temperature sensor for sensing an overheat temperature of either the fan motor FM or the inverter control apparatus, and reference numeral 35 is a display circuit constructed of LED or the like indicative of operation conditions of the vacuum cleaner. The nozzle motor 26, rotary brush 10 and a brush 11 mounted on this rotary brush 10 are employed inside a suction port case 6A of the power brush suction port 6. Reference numeral 12 indicates a timing belt for transporting drive force of the nozzle motor 26 to the rotary brush 10; reference numeral 13 indicates a suction extension tube; and reference numeral 14 represents a roller. A power source lead wire 9 of the nozzle motor 26 is connected to a power source line 5A employed in the extension tube 5.

As a consequence, when power is supplied to the nozzle motor 26 and then this nozzle motor 26 is rotated, the rotary brush 10 is rotated via the timing belt 12. While the rotary brush 10 is rotated and the power brush suction port 6 is set in contact with the floor plane 1, since the brush 11 is mounted or the rotary brush 10, the brush 11 is set in contact with the floor plane 1 and the load current $I_N$ of the nozzle motor 26 becomes large. As a result of the various experiments, the following facts have been discovered. That is, since the nozzle motor 26 is rotated in one direction and the rotary brush 10 is also rotated in one direction, in case that the power brush suction port 6 is operated along front/rear directions, the load current $I_N$ of the nozzle motor 26 becomes small under such a condition that the power brush suction port 6 is manipulated in the direction along which the power brush suction port 6 is advanced when the rotary brush 10 is rotated. The load current $I_N$ of the nozzle motor 26 becomes large when the power brush suction port 6 is operated in another direction opposite to the above-described direction.

Figure 5:
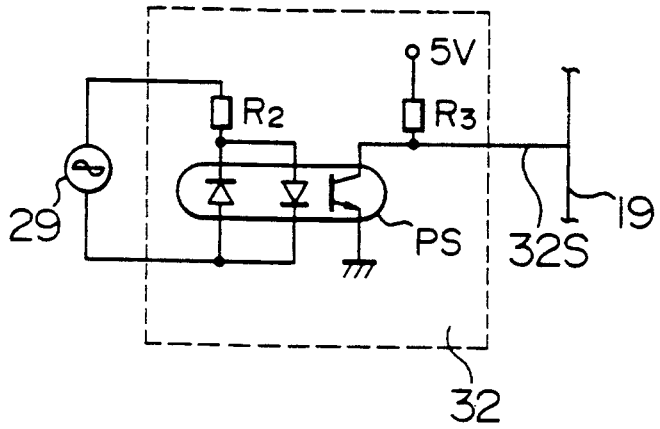
FIG. 5 is a circuit diagram of a zero-cross detecting circuit for an AC power supply voltage in the control circuit shown in FIG. 2.

A description will now be presented of variations in the load current of the nozzle motor in response to the operations of the suction port. FIG. 5 is a circuit diagram of a zerocross detecting circuit for controlling the phases of the nozzle motor. FIGS. 6A, 6B, 6C and 6D represent waveforms of voltages and currents supplied to the nozzle motor.

Figure 6A:
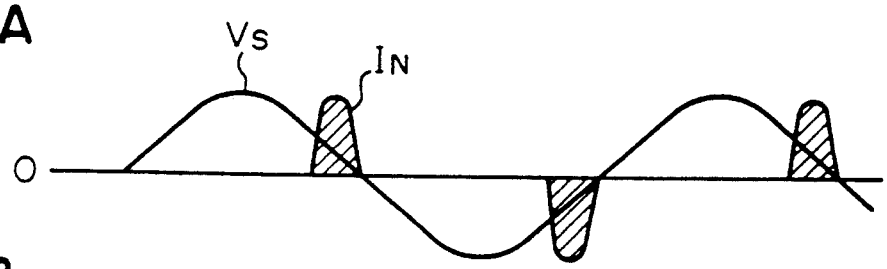
FIGS. 6A, 6B, 6C and 6D show waveforms of a voltage applied to a nozzle motor, a current, a zerocross signal, and a count timer and FLS trigger signal.
Figure 6B:
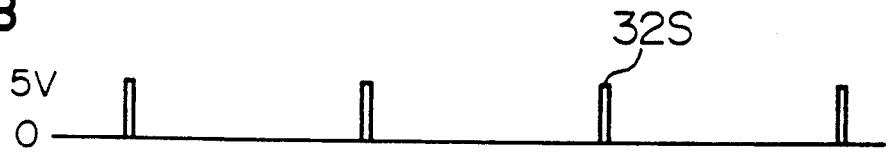
Figure 6C:
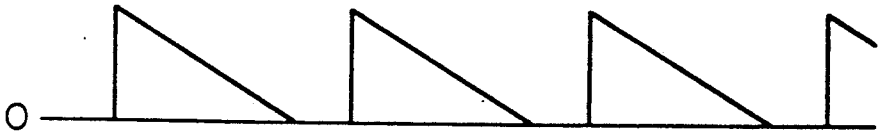
Figure 6D:
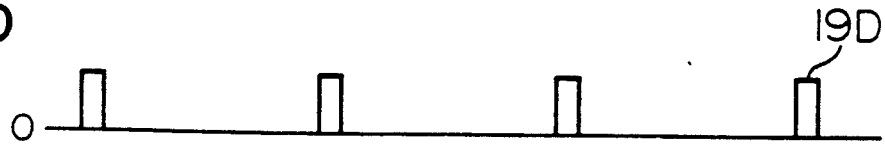

In FIGS. 5, 6A, 6B, 6C, and 6D, if the AC power supply 29 applies a voltage "Vs" shown in FIG. 6A, a zerocross signal 32S shown in FIG. 6B is obtained by the zerocross detecting circuit 32 constructed of a resistor R2, a photocoupler PS and a resistor R3. The microcomputer 19 causes a count timer shown in FIG. 6C and synchronized with a rising edge of this zerocross signal 32S to be synchronized, and outputs the ignition signal 19D to the triac FLS 25 when the count timer becomes zero (although not shown in the figures, the zerocross signal 32S may be inverted in order that the count timer is operated in synchronism with the falling edge of the zerocross signal). As a result, the load current $I_N$ as shown in FIG. 6A flows through the nozzle motor 26 and the rotational speed of the nozzle motor 26, so-called "input" thereof may be controlled by the phase control.

Figure 7A:
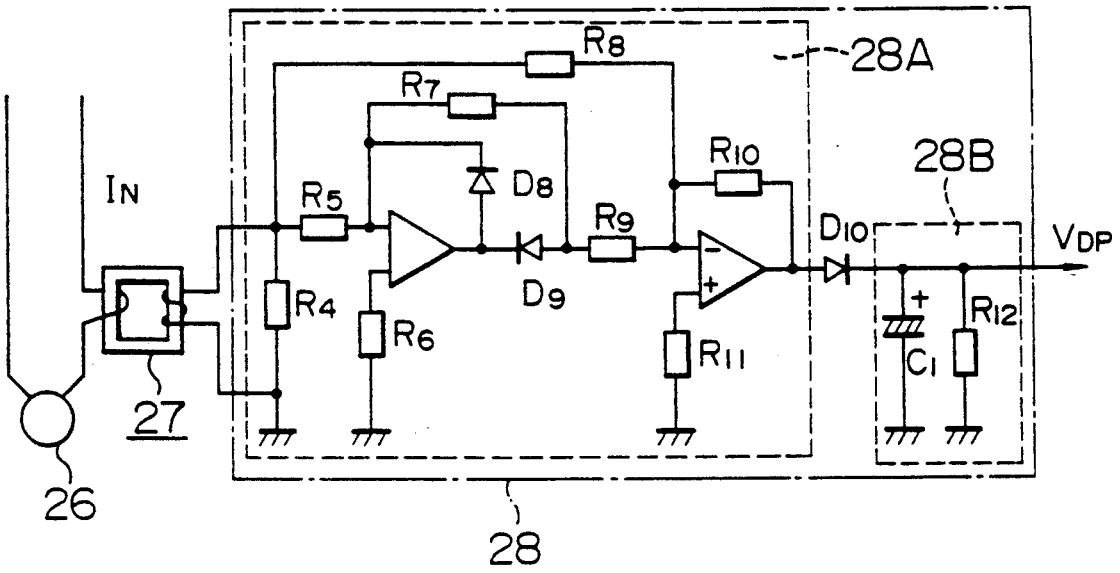
Figure 7B:
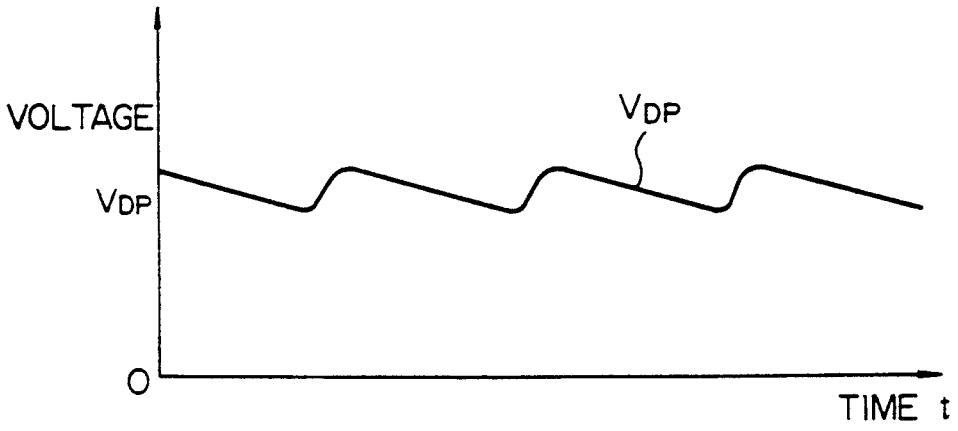
Figure 7C:
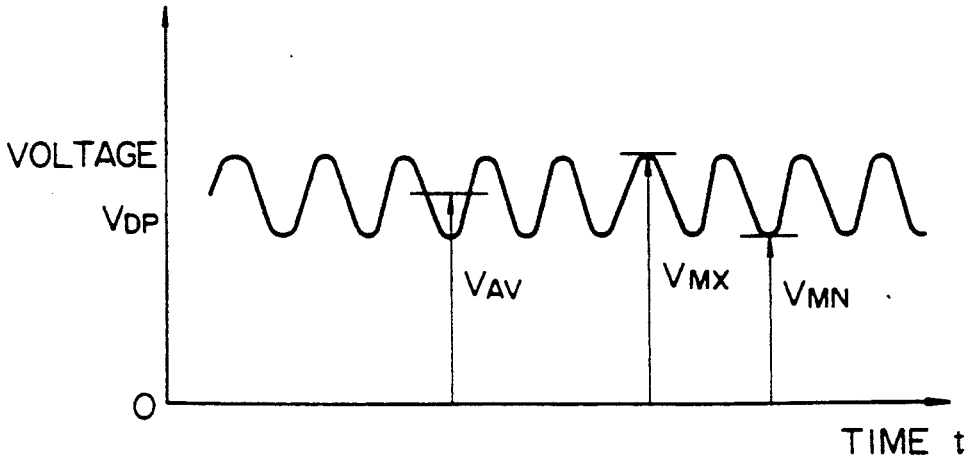

FIGS. 7A, 7B and 7C represent a circuit arrangement of a current detecting circuit for the nozzle motor and an output example thereof. Since the load current $I_N$ supplied to the nozzle 26 represents an interrupted AC current waveform as represented by FIG. 6A, this load current $I_N$ is detected by a current detector 27 constructed of a current transformer and then the detected load current $I_N$ is inputted into a current detecting circuit 28. The current detecting circuit 28 includes a full-wave rectifying/amplifying circuit 28A, a diode $D_{10}$, and a peak hold circuit 28B, and converts the detected current into a DC voltage signal $V_{DP}$ corresponding to the peak current of the load current $I_N$ as shown in FIG. 7B (the reason why the peak current of the load current $I_N$ is detected, is that the peak current gives an adverse influence to the nozzle motor 26, and also this peak current is considerably varied in response to the various operations of the suction port). As represented in FIG. 7C, this output signal $V_{DP}$ is varied between the voltages $V_{MX}$ and $V_{MN}$ in accordance with the various operations of the suction port while the suction port is manipulated. A difference in both of these voltages ($V_{MX}-V_{MN}$) is assumed as a variation width $V_{MB}$ of the detection voltage, and an average value $V_{AV}$ of the detection voltage corresponding to an average value $(V_{MX}-V_{MN})/2$.

Figure 8:
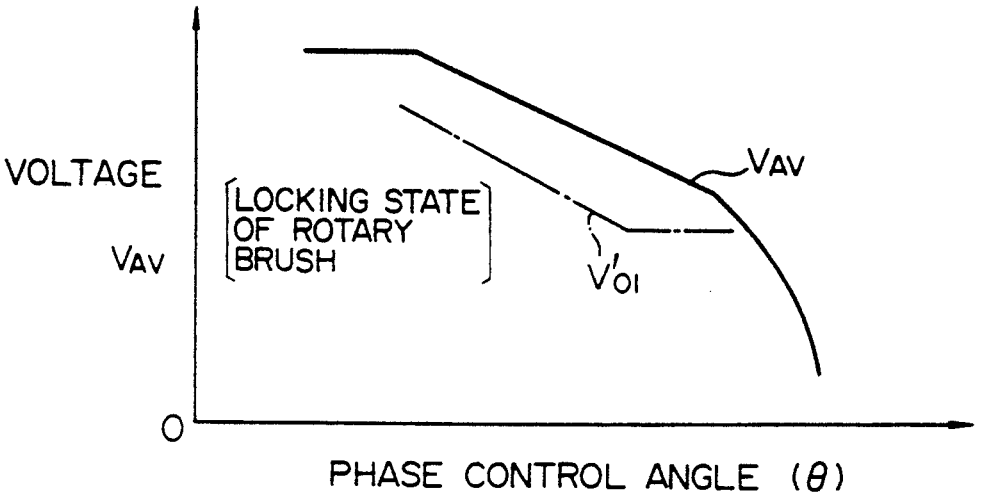
FIG. 8 represents average values of detection voltages with respect to phase control angles when a rotary brush is locked.

FIG. 8 represents an average value "$V_{AV}$" of detection voltages with respect to variations in the phase control angles when the rotary brush is locked. In case that the rotary brush is locked and the phase control angle becomes large, since the voltage applied to the nozzle motor is low, the average value $V_{AV}$ of the detection voltages is also small. To the contrary, in accordance with decreasing of the phase control angle, since the voltage applied to the nozzle motor becomes high, the average value "$V_{AV}$" of the detection voltages becomes similarly large. As a consequence, the locking state of the rotary brush may be detected based upon this average value $V_{AV}$ of the detection voltages, which is varied depending upon the operations of the air suction port.

Figure 9:
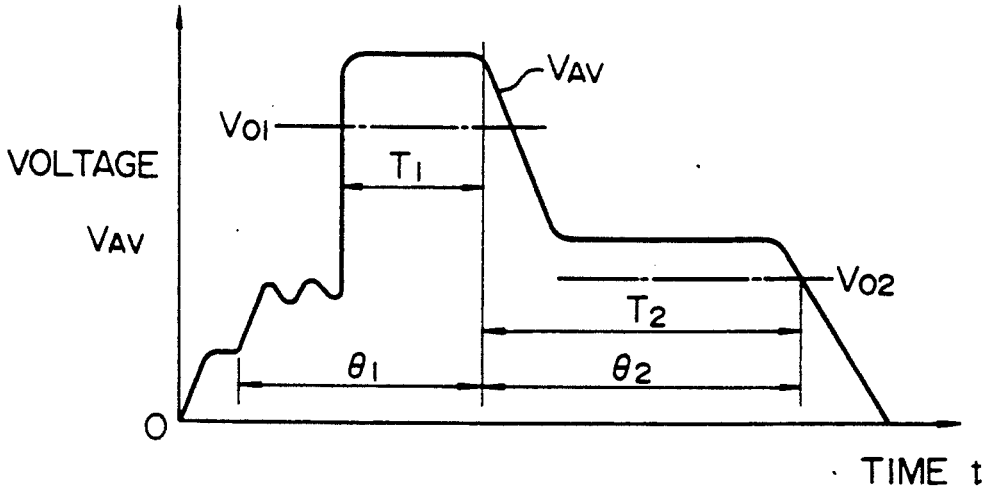
FIG. 9 represents changes in the average voltages of the detection voltages when the rotary brush is locked during cleaning operation.

FIG. 9 indicates variations in the average values $V_{AV}$ of the detection voltages when the rotary brush is locked while operating the air suction portion. When the vacuum cleaner is operated and the air suction portion is manipulated, the variations as shown in this figure appear in the average value $V_{AV}$ of the detection voltages (phase control angle Q of the nozzle motor), and if the rotary brush is locked, the average value $V_{AV}$ of the detection voltages is suddenly increased by an effect of the peak hold circuit. At this time, it is judged that the rotary brush is brought into the locking state if the average value $V_{AV}$ higher than a first setting value $V_{01}$ has been continued for more than a first setting time $T_1$. Since the load current of the nozzle motor becomes very high under the locking state of the rotary brush, damage to the components around the commutator of the nozzle motor may be prevented if the operation of the nozzle motor is interrupted. However, if the nozzle motor would be stopped, an operator of this vacuum cleaner may feel strange, which would be inconvenient for the user.

Figure 10:
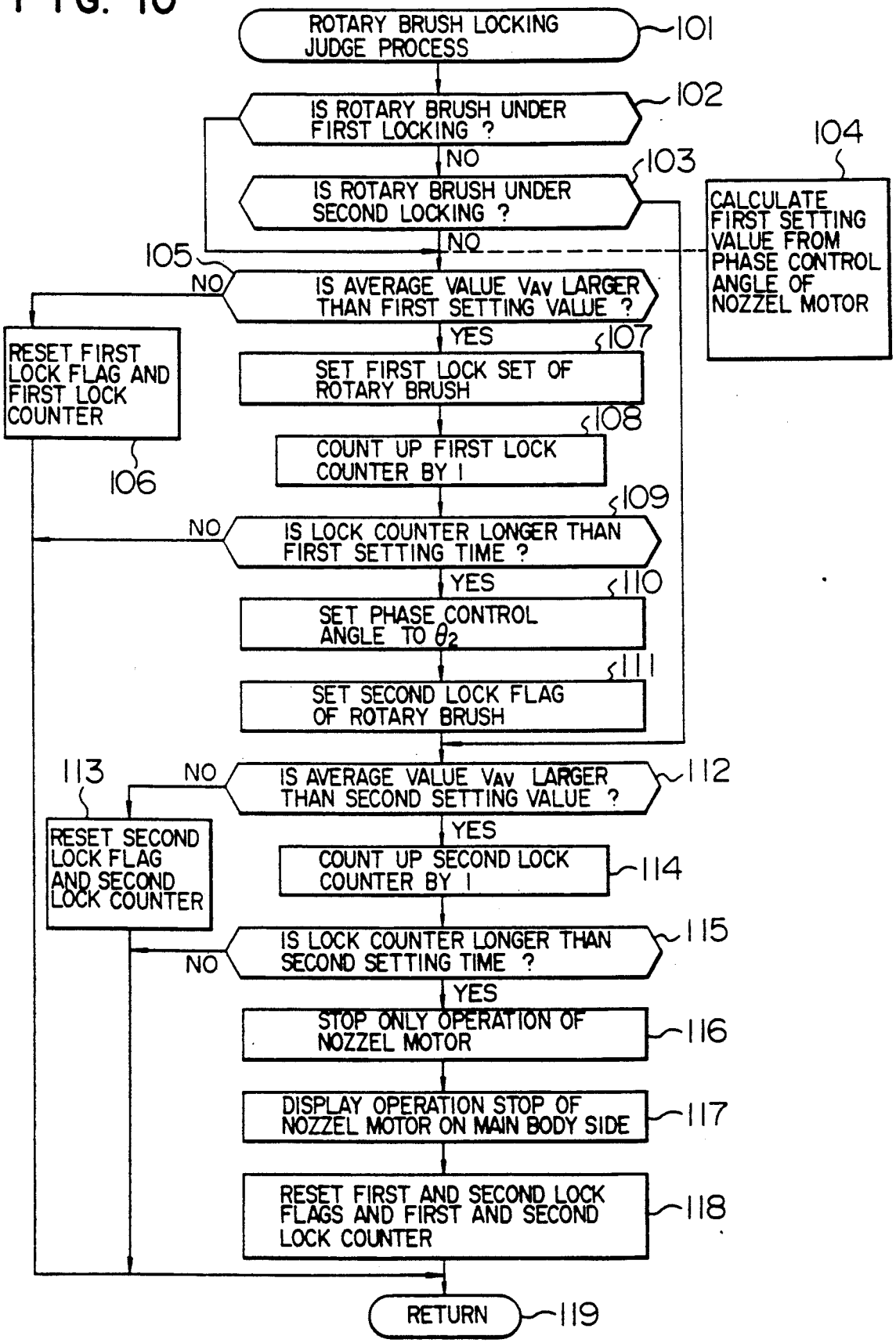
FIG. 10 is a flow chart for explaining a judgement of the locking phenomenon of the rotary brush.

Thus, when a judgement is made of the locking state of the rotary brush, the phase control angle is increased to "Q2" so that the voltage applied t the nozzle motor is lowered. At this time if the average voltage $V_{AV}$ higher than a second setting value $V_{02}$ is continued for more than a second setting time T2, it is judged that the rotary brush is locked and therefore the drive of the nozzle motor is stopped. As a consequence, if either the average value $V_{AV}$ of the detection voltages exceeds the first setting value $V_{01}$, or the judgement is made that the rotary brush is brought into the locking state, under such a state that an operator leaves the air suction port on a cleaning floor surface as it is, since the rotary brush is rotated, the judgement of locking the rotary brush is released. Here, in case that a judgement is made that the rotary brush is under the locking state, since the voltage applied to the nozzle motor is lowered, the load current flowing through the nozzle motor is small and damage to the components around the commutator of the nozzle motor can be avoided. In FIG. 10, there is shown a flow chart for explaining the locking state judgement of the rotary brush. A process 104 indicated by a dot line of this figure is performed such that as represented in FIG. 8, since the average value $V_{AV}$ of the detection voltages is changed by the phase control angle 101, the first setting value $V_{01}$, with respect to the phase control angle 6, as shown in a dot/dash line, is calculated so as to increase precision of judgement for the locking state of the rotary brush, and when the average value $V_{AV}$ exceeds this value, the locking state of the rotary brush may be judged.

Figure 11:
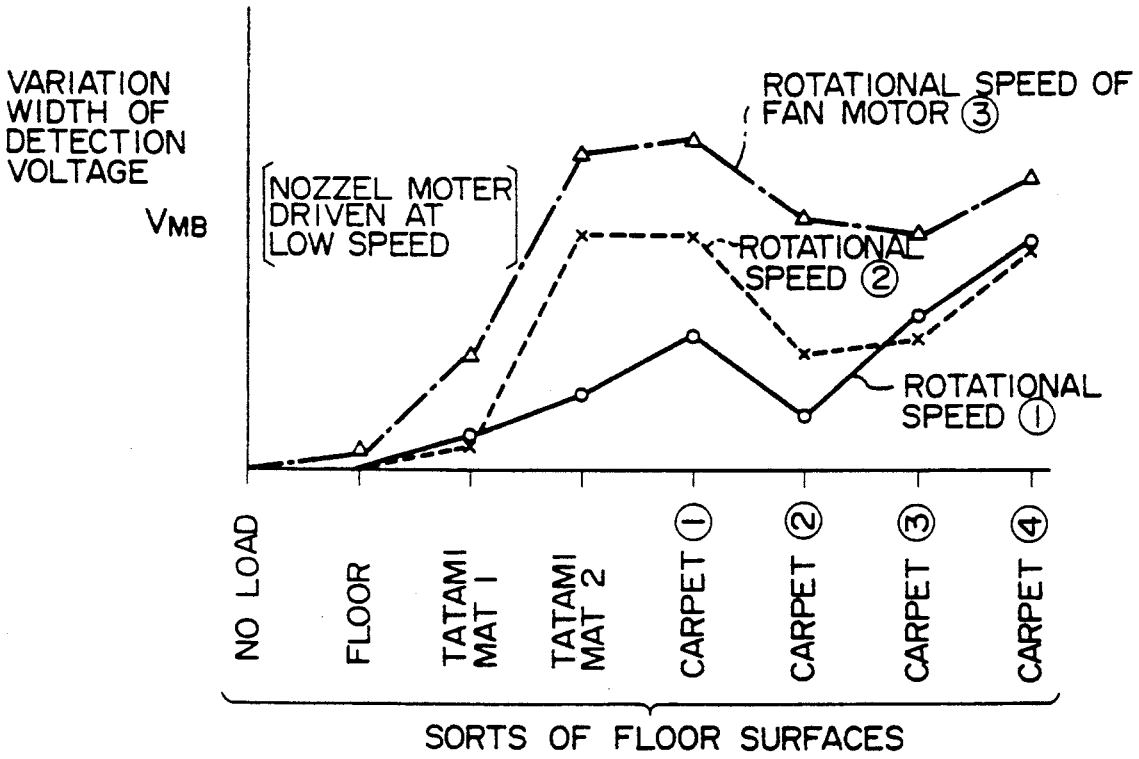
FIG. 11 represents variations in peak values of the nozzle motor currents with respect to a floor surface when the nozzle motor is rotated at a low speed.

In accordance with the present embodiment, a cleaning floor surface is judged and suction force is controlled based on the judgement result. This judging method for the cleaning floor surface will now be explained. In this preferred embodiment, a floor surface is judged based upon the load current of the nozzle motor and/or the static pressure within the vacuum cleaner. A description will now be first made of such a judgement performed with employment of variation widths of the load currents for the nozzle motor. FIG. 11 represents judgement results in a variation width $V_{MB}$ of detection voltages corresponding to variations in the load current of the nozzle motor under low rotational speeds thereof when the suction port is operated, in accordance with the floor surfaces. It should he noted that the rotational speed of the fan motor is successively increased from a rotational speed ① to a rotational speed ③. In other words, the air suction force of the vacuum cleaner becomes successively large. A carpet ① through a carpet ④ indicate lengths of carpet piles which become large in this order. In FIG. 11, consider whether or not different cleaning floor surfaces may be predicted based on the variation width $V_{MB}$ of the detection voltages. When the air suction force of the rotational speed ① is low, the variation width $V_{MB}$ is equal to zero in case of a bare floor. The variation widths are successively increased in the order of a tatami mat (Japanese straw mat) I, a tatami mat 2, and a carpet. It should be noted that the tatami mat 1 implies that since straws are arranged along one direction on a surface of the tatami mat, the suction port of the rotary brush is swept along this straw arranging direction, whereas the tatami mat 2 implies that the suction port of the rotary brush is swept along another direction perpendicular to the straw arranging direction. Also, it should be noted that the variation width for the tatami mat 2 is greater than that of the carpet ②. This variation width is similarly applied to the rotational speeds ② and ③, and so one cannot merely judge the sorts of floor surfaces based on the large or small variation widths VMR. However, it may be understood that discrimination can be made between the bare floor and other cleaning surfaces.

Figure 12:
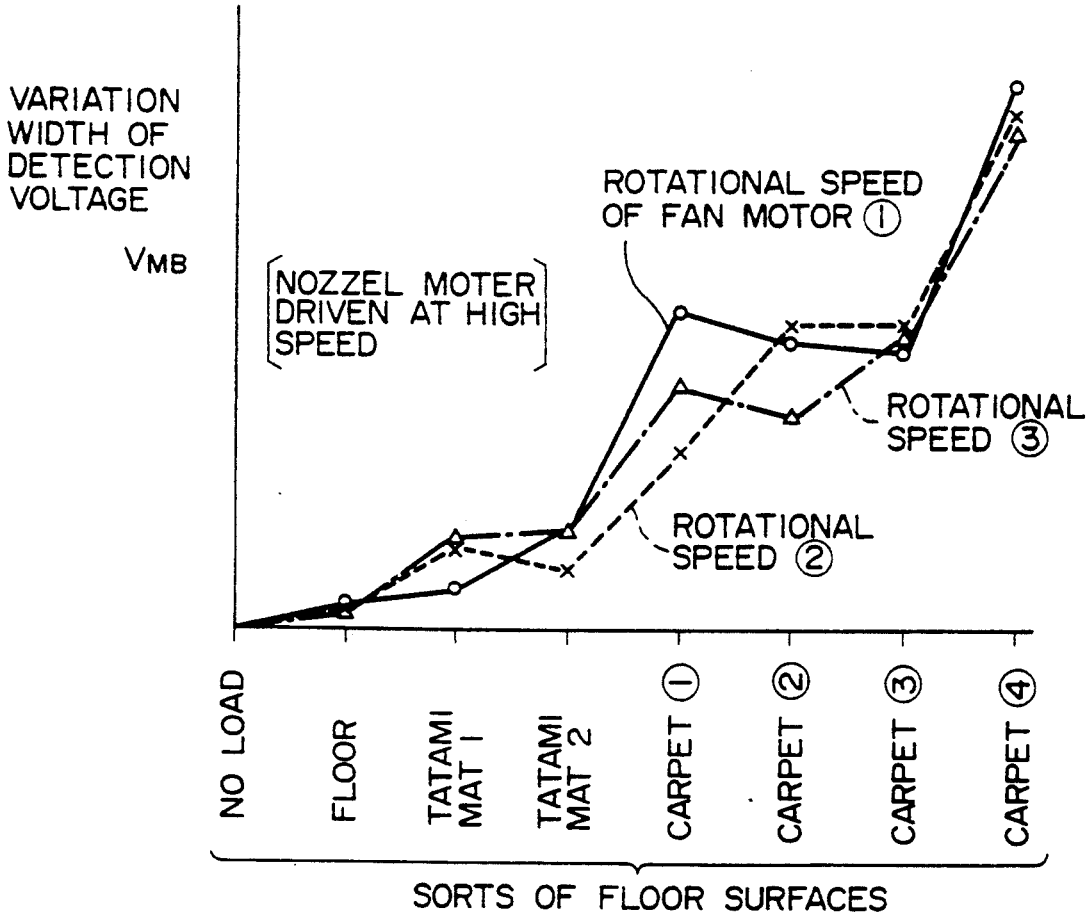
FIG. 12 represents variations in peak values of the nozzle motor currents with respect to a floor surface when the nozzle motor is rotated at a high speed.

FIG. 12 represents measurement results of variation widths $V_{MB}$ in detection voltages with respect to variations in load currents of the nozzle motor rotated at high speed while the suction port is operated, depending upon different floor surfaces. In FIG. 12, in case the nozzle motor is driven at high rotational speeds, since the variation widths $V_{MB}$ of the detection voltages are gradually increased from the bare floor, tatami mats 1, 2, and carpets ①-④ substantially without regard to the rotational speeds ① to ③ of the fan motor, the types of floor surfaces can be judged. In other words, the rotational speeds of the nozzle motor and fan motor are adjusted depending upon the judgement results of the floor surfaces, so that the types of floor surfaces can be judged with employment of the variation widths $V_{MB}$ of the detection voltages.

While the floor surface judgement with employment of the variation widths $V_{MB}$ of the detection voltages corresponding to the peak current value of the nozzle motor has been described, another floor surface judgement with employment of outputs from a pressure sensor provided within a main body of a vacuum cleaner will now be described.

Figure 13:
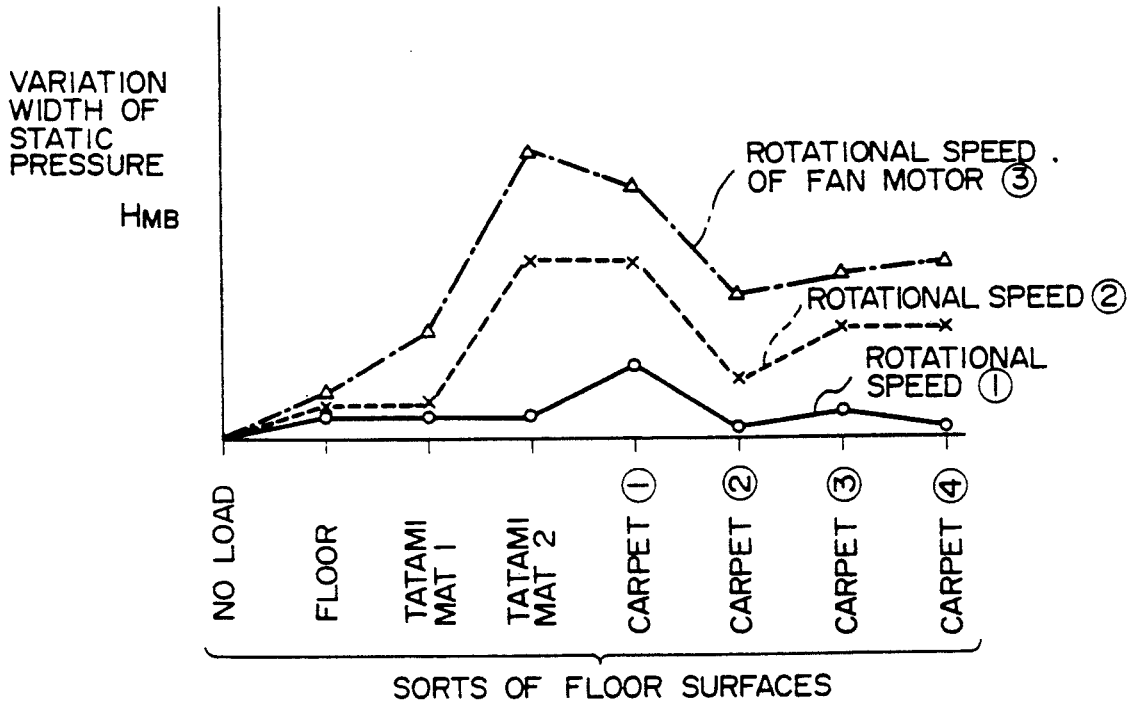
FIG. 13 represents variations in static pressure with respect to a flow surface.

FIG. 13 indicates measurement results of variation widths $H_{MB}$ of static pressure with respect to rotational speeds of the fan motor, depending upon the floor surfaces. In FIG. 13, it is apparent that although both a bare floor and tatami mats can be discriminated from each other, no discrimination can be made between tatami mats and carpets, which is also dependent upon the rotational speeds of the fan motor.

Furthermore, since both the variation width $V_{MB}$ of the detection voltages and the variation width $H_{MB}$ of the static pressure are different from each other, depending upon the operation force used by an operator, the conditions of the cleaning floor surfaces and sorts of brushes employed in the rotary brush, there are some possibilities to erroneously judge the sorts of floor surfaces by utilizing only the magnitudes of the variation widths $V_{MB}$ and $H_{MB}$. Thus, such an erroneous judgement for the sorts of cleaning floor surfaces may be compensated with employment of a fuzzy inference capable of considering fuzzy states.

Figure 14:
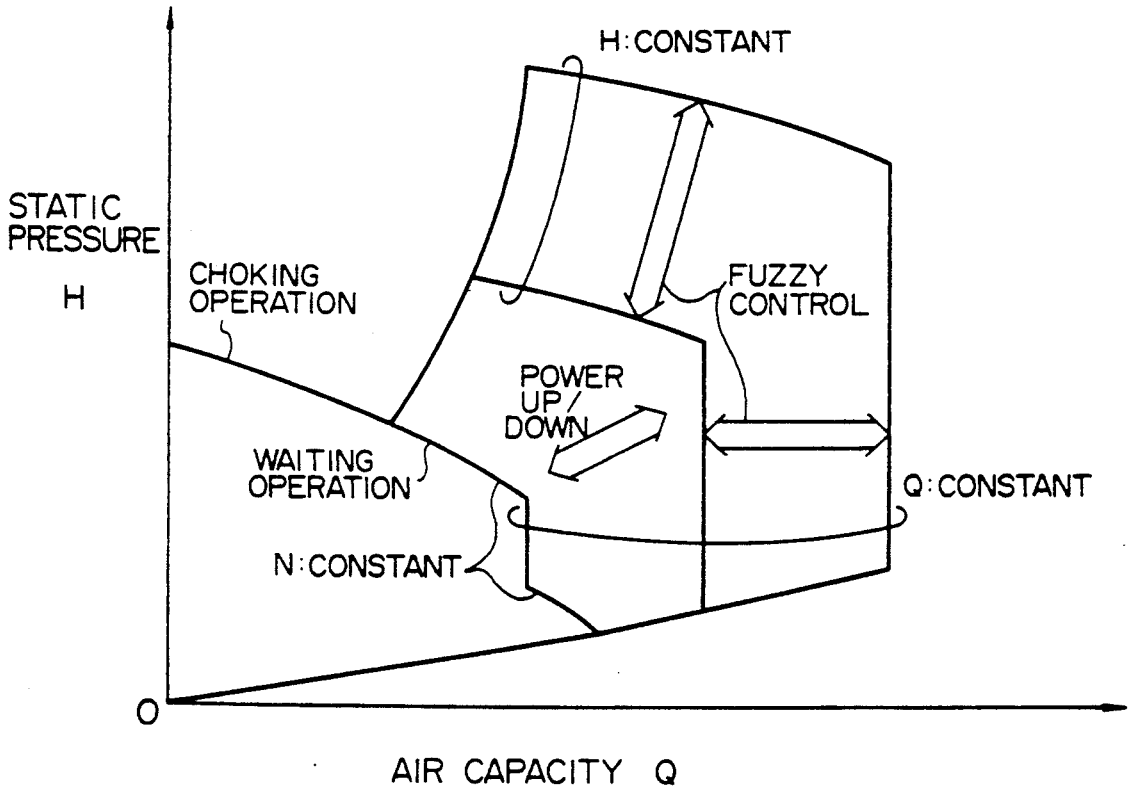
FIG. 14 illustrates a generic FUZZY predicting method.

FIG. 14 represents an operation mode of the fan motor. Here, air intake pressure "$P_0$" of a vacuum cleaner is directly proportional to a product between air capacity "Q" and static pressure "H". In FIG. 14, a control of constant air capacity "Q" is to continuously maintain a minimum air capacity required at the air intake port. A magnitude of static pressure is increased only by lost pressure depending upon a choked filter. A control of constant static pressure H is to relax contact established between a floor surface and an air intake port. For instance, even when an article is attached to the air intake port, since the static pressure is not increased to a certain extent, there is a merit to easily remove this article. The reason why the static pressure is increased in accordance with decrease in the air capacity is that the static pressure is increased at the air intake port by lost pressure in the filter unit, due to the constant static pressure control for the filter rear port. It should be noted that since there is substantially no air intake force when the air capacity becomes small, the present control is advanced to a control of constant rotational speed "N" so as to avoid useless power. The fan motor is controlled under the above-described fuzzy control within two ranges between the constant air capacity "Q" and the constant static pressure "H".

On the other hand, if the power of the fan motor is increased when no cleaning operation is performed, noisy motor operation sounds are produced, and also motor power is uselessly consumed. As a consequence, a waiting operation mode is employed only when a cleaning operation is carried out by manipulating the air intake port, the motor power is increased and the operation is controlled by the fuzzy control. Otherwise, the motor power is decreased, and the operation is returned to the waiting operation. In the waiting operation mode, to increase the judgement precision as to whether or not the present operation is under the cleaning state, if the air capacity becomes a certain value under the control of constant rotational speed, the control of constant air capacity is performed, and also if the static pressure becomes a certain value, the control of constant rotational speed is carried out.

Figure 15:
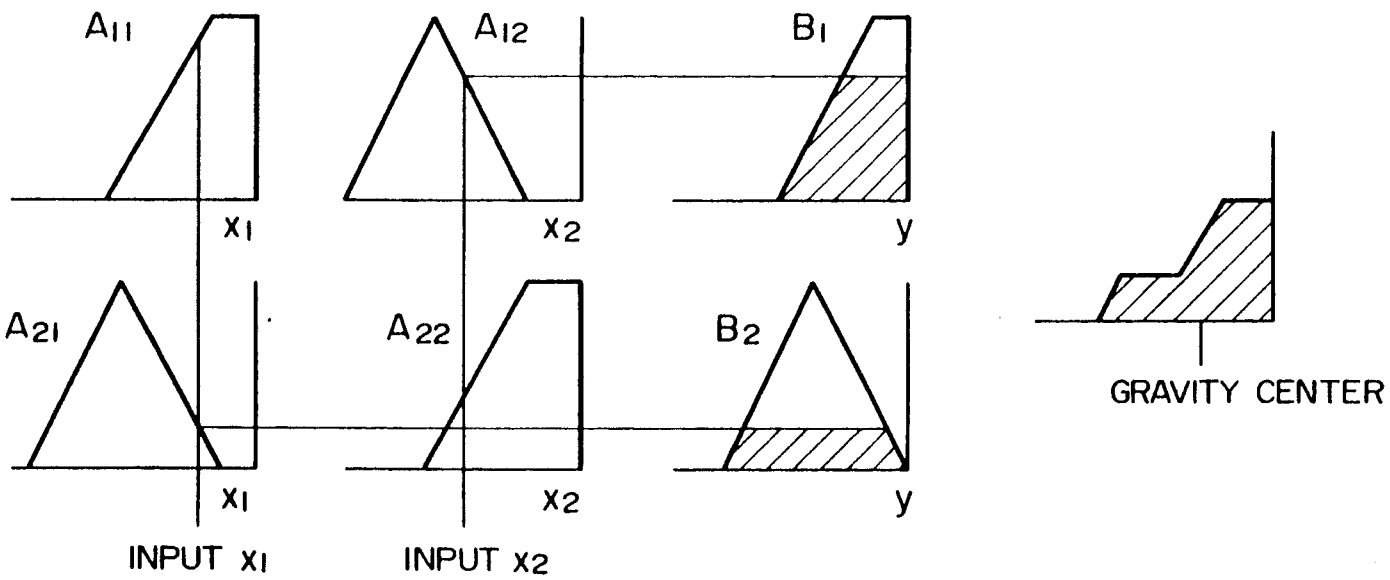
FIG. 15 is a diagram for showing a general fuzzy inference.

A description will now be made of the fuzzy control. FIG. 15 represents a general fuzzy inference. That is, the fuzzy inference is constituted by a front clause part and a rear clause part of "if-then rule". In accordance with a rule 1, based upon an adaptable degree of the front clause part with respect to a membership $A_{11}$ of an input $X_1$, and also a smaller adaptable degree among adaptable degrees with respective to a membership $A_{12}$ of an input $X_2$, an area of a membership B, of an output of the rear clause part is obtained. Similarly, in a rule 2, an area of a membership $B_2$ of an output is obtained. Then, areas corresponding to the number of these rules are superimposed with each other, so that a gravity center is calculated.

Figure 16A:
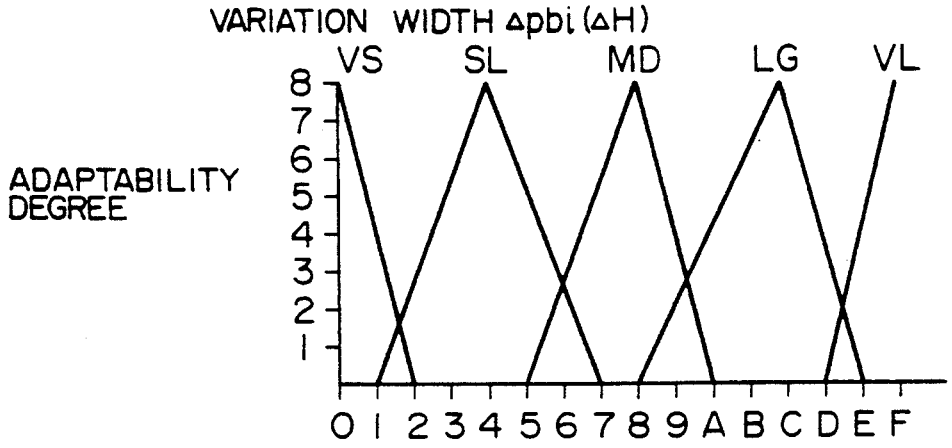
FIGS. 16A, 16B, 16C represent membership functions applied to the vacuum cleaner according to the present invention.
Figure 16B:
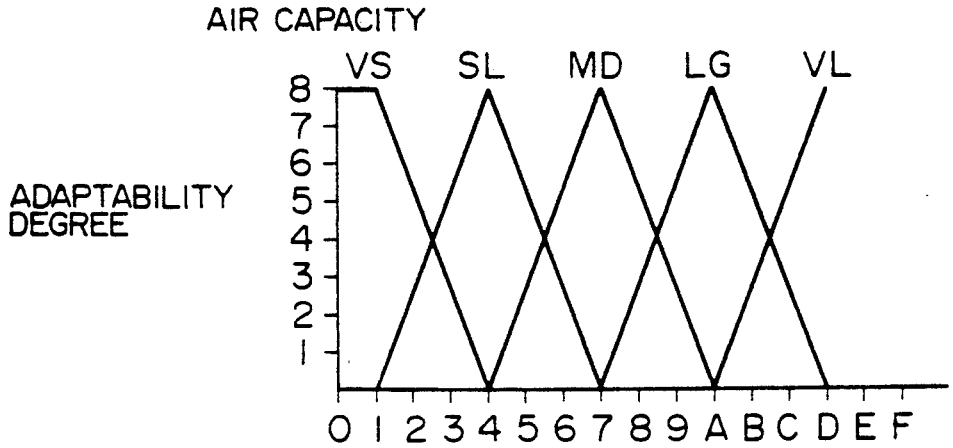
Figure 16C:
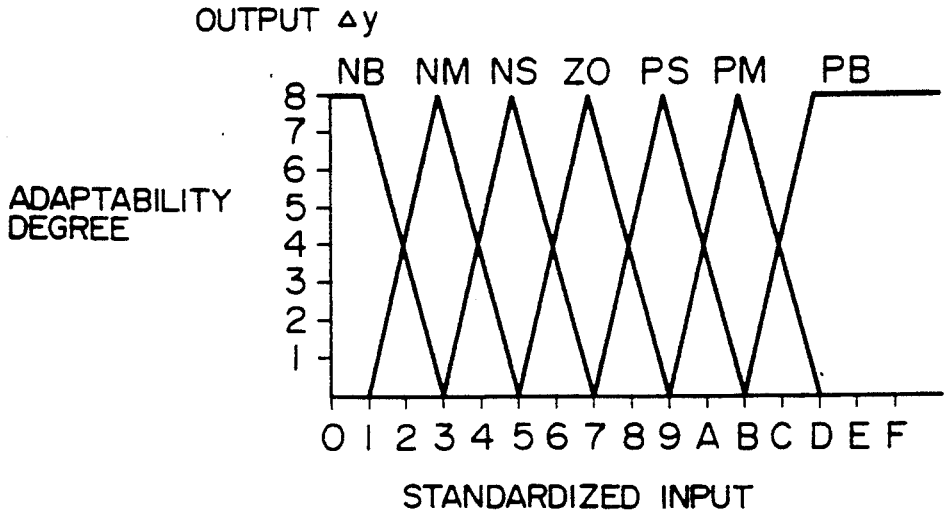
Figure 17:
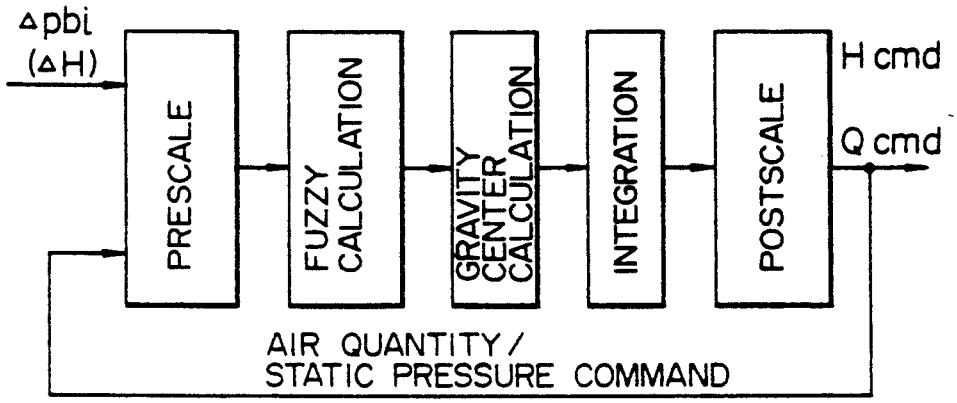
FIG. 17 is a schematic diagram for slowing a FUZZY calculating method applied to the vacuum cleaner according to the present invention.
Figure 18:
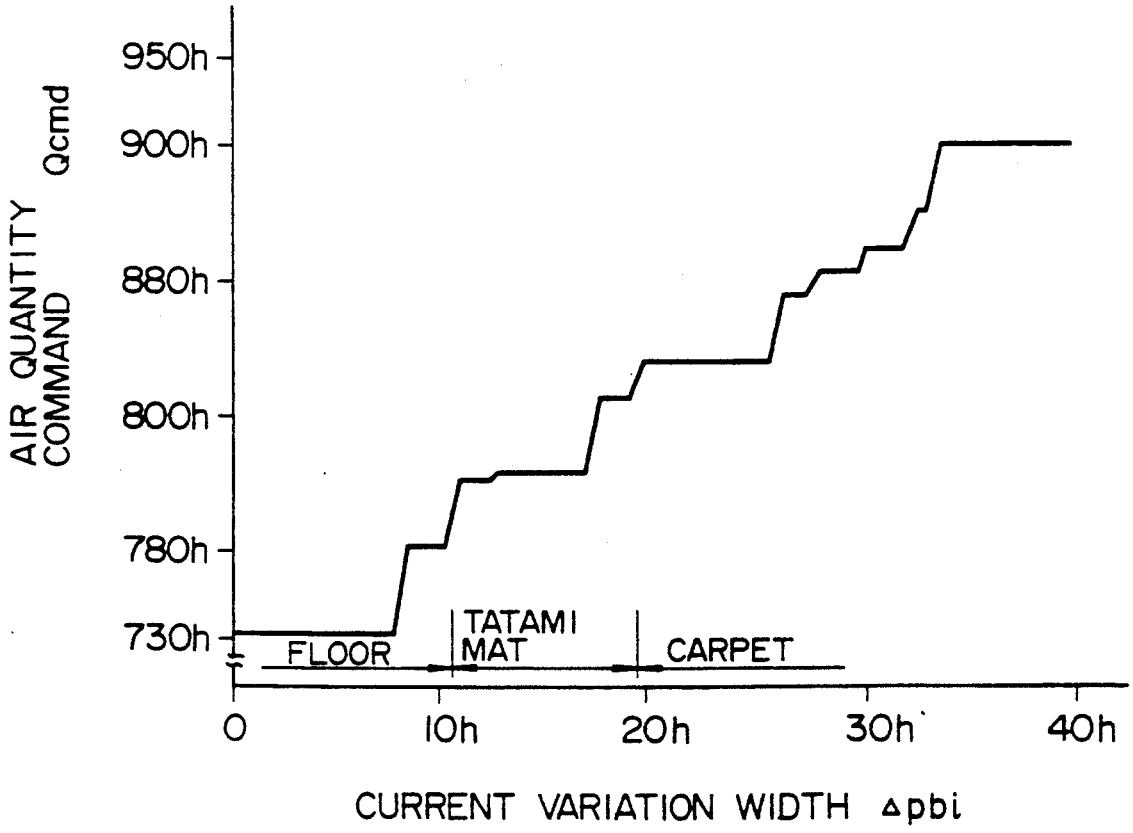
FIG. 18 represents an example of outputs of air-quantity command Qcmd based on the FUZZY calculation with respect to current variations $\Delta$pbi.

In FIG. 23, there is shown a rule table applied to a vacuum cleaner. In this rule table, VS to VL are employed as membership functions of the front clause part and a variation width Δpbi of a current of a fan motor (otherwise, a variation width ΔH of static pressure) and an air capacity 0 of the fan motor (otherwise, static pressure H) are employed as an input of the fuzzy inference (note that the membership functions correspond to the variation width Δpbi, and the membership functions correspond to the variation width ΔH, for the sake of easy understanding in this table). NB to PB are employed as the membership of the rear clause part, and ZO implies a destination where the control is terminated. FIG. 16 indicates a relationship between an input considered for a vacuum cleaner and a membership function. In FIG. 16, a variation width Δpbi of standardized inputs, an air capacity Q (static pressure H) and an output Δy are prescaled by 15 steps, and also adaptability degrees thereof are prescaled by 8 steps. FIG. 17 represents a calculation method of an air capacity command Qcmd and a static command Hcmd by way of the Fuzzy calculation. In accordance with the fuzzy inference rule shown in FIG. 23, both the variation width Δpbi (otherwise, a variation width ΔH) and the air capacity command Qcmd (or, the static pressure command Hcmd) are prescaled, and both the fuzzy calculation and the gravity calculation are executed so as to obtain variations Δy in the output. These variations are integrated and the integrated variations are used as the output of the fuzzy calculation, and finally, are post scaled whereby the air capacity command Qcmd (or, the static command Hcmd) is obtained. The reason why the variations Δy of the output are integrated as the output of the fuzzy calculation, is to realize stability of the output. FIG. 18 represents an example of outputs of the air capacity command Qcmd with respect to the current variation width Δpbi. As apparent from FIG. 18, the air capacity command Qcmd (or, the static command Hcmd) of the output is stepwise changed in accordance with magnitudes of the variation width Δpbi (or, the variation width ΔH) corresponding to the input. The reason why the output is stepwise formed, is to make the outputs constant in case the cleaning floor surface seems to be a floor, a tatami mat, or a carpet. In other words, the fuzzy calculation is employed, and the air capacity command Qcmd (or the static pressure command Hcmd) to compensate for differences in the inputs by the operators is stepwise formed, so that the suction force of the vacuum cleaner can be controlled to an optimum value, depending upon the sorts of the cleaning floor surfaces, without regard to the operators.

Figure 19A:
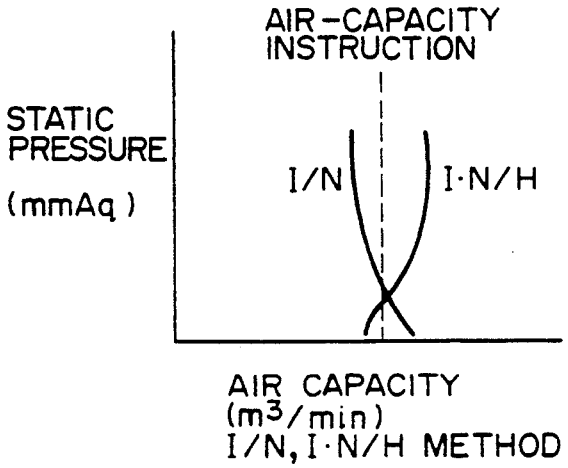
FIGS. 19A, 19B represent a calculation on an air quantity, and a result obtained under control of constant air quantity.
Figure 19B:
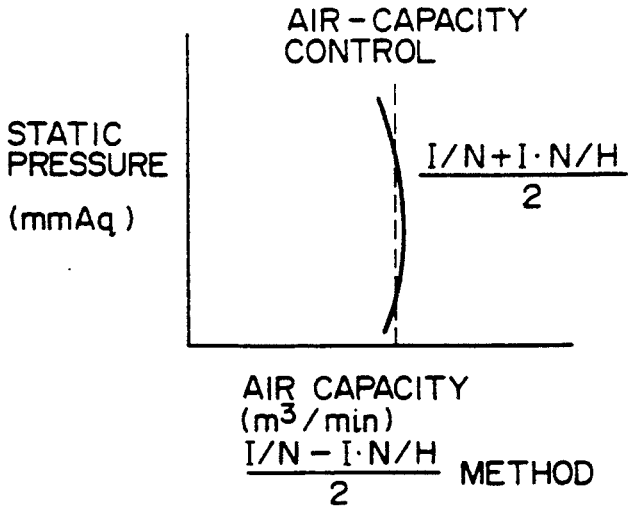

Then, a calculation method of the air capacity is an important factor for the control of constant air capacity. FIG. 19 represents results obtained by the air-capacity calculations and the control of constant air capacity. Based upon a general fluid theory of a fan motor and also a characteristic formula of a motor, the following two formulae will be obtained as the aircapacity calculation formula. The calculation basis will be described later.

$$\text{Qdata} = I/N \qquad \text{(formula 1)}$$

$$\text{Qdata} = I \times N/H \qquad \text{(formula 2)},$$

where symbol "Qdata" indicates a calculation value of an air capacity, symbol "I" indicates a torque current of the fan motor, symbol "N" represents a rotational speed of the fan motor, and symbol "H" is static pressure. FIG. 19A represents a result of the control for constant air capacity by employing the I/N method of (the formula 1) and the I×N/H method of (the formula 2) as the aircapacity calculation formula. FIG. 19B represents a result of the control for constant air-capacity by using a (I/N+I×N/H)/2 method obtained by averaging (the formula 1) and (the formula 2) as the air-capacity calculation formula. The control method for constant air capacity operates to adjust the rotational speed of the fan motor in such a manner that the calculation value of the air capacity is present between an upper limit value and a low limit value of the air capacity instruction value. As a result, the air capacity at the suction port can be controlled to a constant value in accordance with the air-capacity instruction. The control precision of the method as shown in FIG. 19B is better. Although not shown in the figures, the control method for constant static pressure operates to adjust the rotational speed of the fan motor in such a manner that the detected static pressure value is similarly present between the upper limit value of the instructed static pressure value and the lower limit value thereof.

Figure 20A:
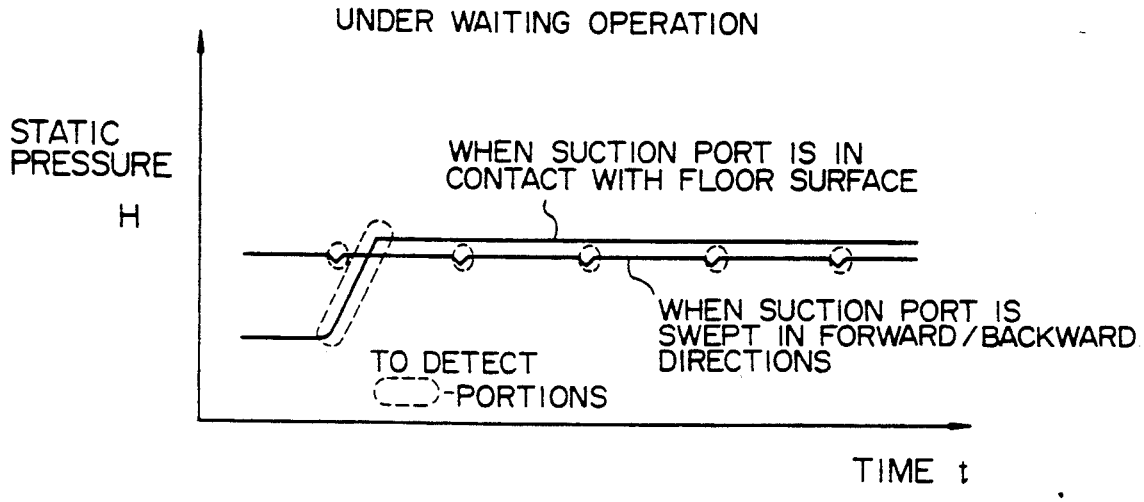
Figure 20B:
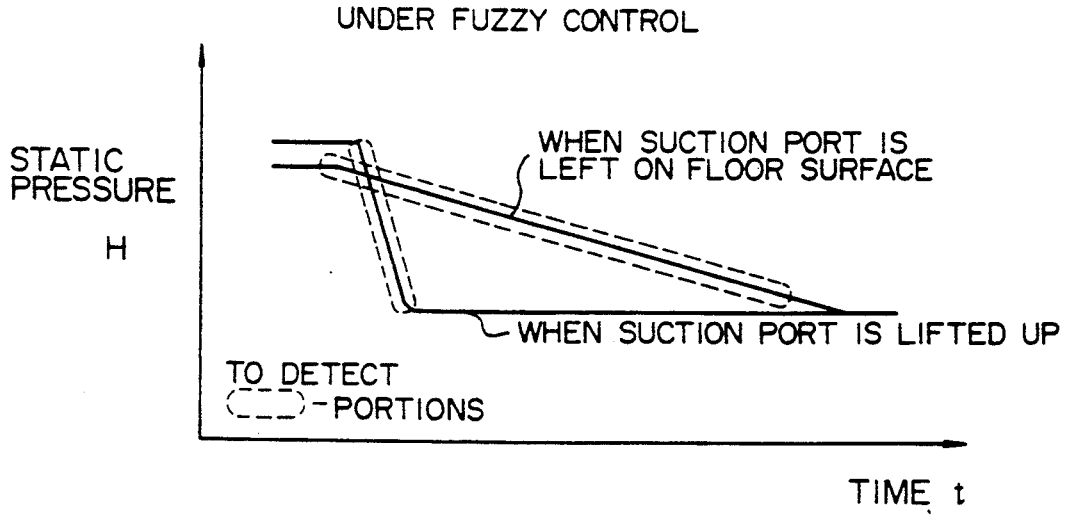

A changing operation between the fuzzy control and the writing operation, which has been described with reference to FIG. 14, will now be explained. FIGS. 20A and 20B represent variations in static pressure during the waiting operation and fuzzy control operation, respectively. FIG. 20A represents variations in the static pressure in case that the air suction port is positioned on the floor surface and swept along in forward and backward directions, and also variations in the static pressure in case the air suction port is moved from the lift up state to planing on the floor surface during the waiting operation under which the output gain of the output sensor is increased (increasing of sensitivity). A judgement whether or not the vacuum cleaner is under cleaning state is established by detecting a portion surrounded by a dot line, namely a very small charge in the static pressure in a positive direction. Then, if it is so judged that the vacuum cleaner is under the cleaning state, the power of this vacuum cleaner is increased and the control state is moved to the fuzzy control. FIG. 20B represents both variations in static pressure in case that the air suction port is left on the cleaning floor surface during the cleaning operation, i.e., under no cleaning state, and variations in static pressure in case that the air suction port is moved from placing of the suction port on the floor surface to lifting up of this suction port. A judgement as to whether or not the vacuum cleaner is under the cleaning state is performed by detecting a part surrounded by a dot line, namely variations in the static pressure in a negative direction. If the judgement result is made of non-cleaning state, the power of the vacuum cleaner is decreased and the control state is advanced to the waiting state. It should be noted that although the judgement of non-cleaning state was down by detecting the variations in the static pressure in the negative direction, such a judgement may be performed by detecting no change in the static pressure.

A judgement of which air suction port is to be used will now be described.

Figure 26:
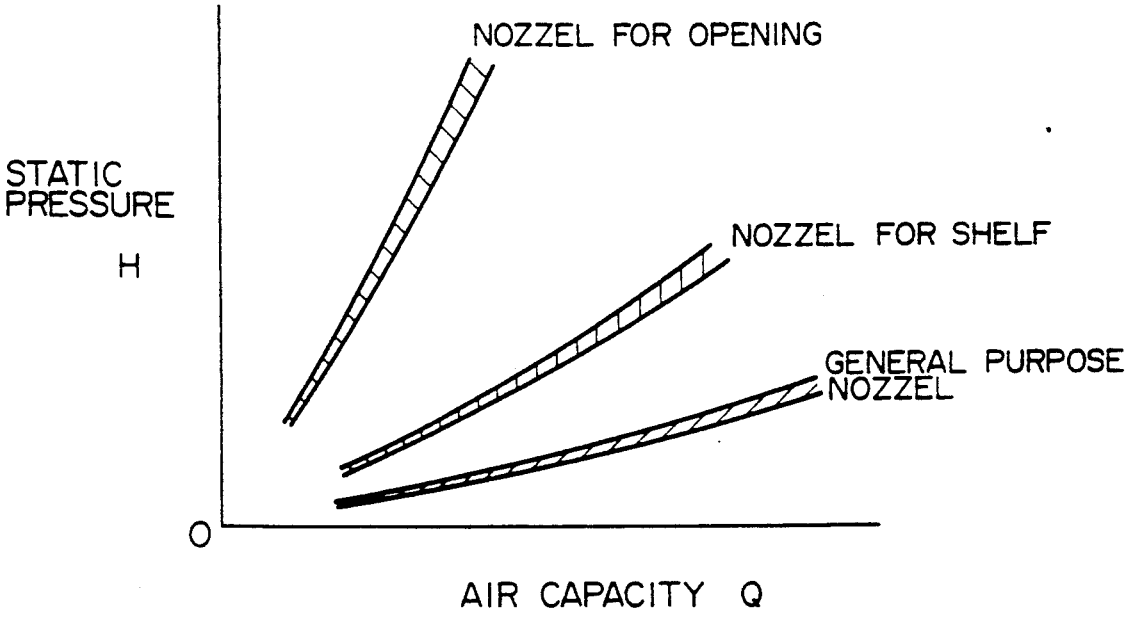
FIG. 26 is a representation of measurement results for a relationship between air capacities and static pressure with respect to nozzles for an opening, a shelf and a general purpose.

FIG. 26 represents a relationship between air capacities and static pressure with respect to typical air suction ports for, i.e., an opening, a shelf, and a general-purpose. An air suction port of a power brush belongs to this general purpose suction port. Discrimination between the power-brush suction port and no power brush suction port is performed in such a manner that an instantaneous voltage is applied to the nozzle motor based upon the zerocross signal. If a current is sensed, it can be judged that the power brush suction port is employed with the vacuum cleaner. If no current is detected, it can be judged that other air suction ports are employed. When the power brush suction port is employed, the variation width Δpbi of the current of the nozzle motor is used as the input of the fuzzy calculation. When a suction port other than the power brush suction port is employed, the variation width ΔH of the static pressure is used as the input of the fuzzy calculation.

Subsequently, a judgement process for quick interruption of a power source will now be described. Upon interruption of the power source, the control system of the fan motor increases the current instruction in order to be equal to the rotational speed of the speed instruction, and finally becomes a duty ratio of 100%, thereby being brought into a voltage control state (uncontrolled state). At this time, when the voltage of the power source has recovered, since the control system of the fan motor is under the voltage control state, overcurrent flows through the fan motor so that the magnet may be demagnetized. As a consequence, if the zerocross signal is not detected during a half cycle time period of the frequency of the power source, it is so judged that the power source is instantaneously interrupted. Thus, the rotational speed instruction of the fan motor is minimized and then the fan motor is continuously brought under control condition of rotational speed. If no zerocross signal is sensed for more than a predetermined time period, a judgement is made that the power source is instantaneously interrupted, so that operation of the vacuum cleaner is stopped and a stop state is displayed on a display circuit.

Figure 21:
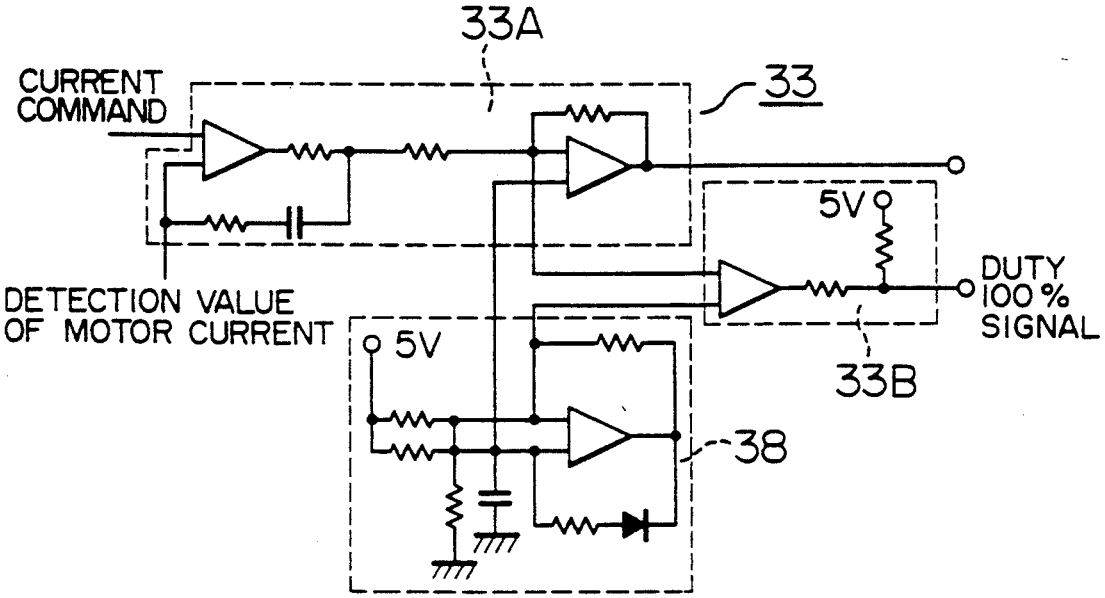
FIG. 21 is a circuit diagram of a detecting circuit for a duty ratio of 100%.
Figure 22:
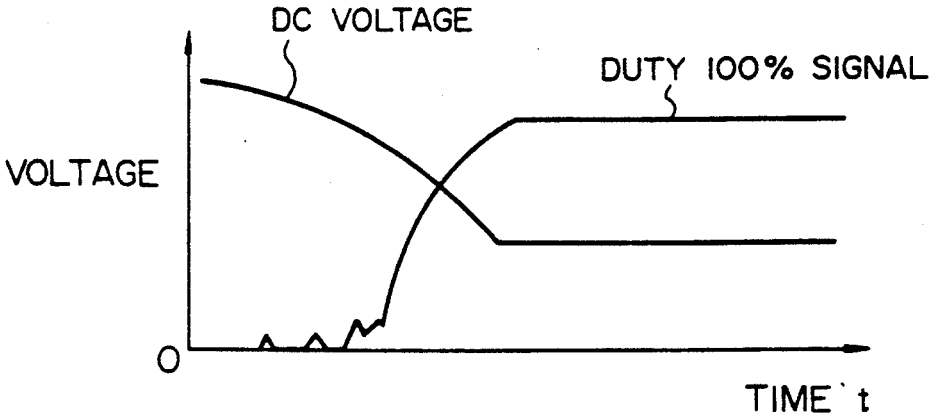
FIG. 22 represents an example of a duty ratio of 100% signal of the detecting circuit shown in FIG. 21.

Next, a judgement process of a duty ratio of 100% will now be described. When it becomes a duty ratio of 100%, the above-described problem may occur. As conditions when it becomes a duty ratio of 100%, there are two cases that the above-described power source is instantaneously interrupted, and also the voltage of the power source is lowered. The control system of the fan motor increases the current command when the voltage of the power source is reduced in order to be equal to the rotational speed of the speed command, and finally is brought into a duty ratio of 100% of the voltage control state. At this time, if the power source voltage is recovered, the same problem as in the case of the instantaneous instruction of the power source occurs. FIG. 21 represents a detecting circuit for a duty ratio of 100%. The duty 100% detecting circuit 33 is arranged by a chopper signal generating circuit 33A consisting of a (proportion+integration) circuit into which both the current command and the detection value of the motor current have been inputted and a comparator into which an output of a triangle wave generating circuit 38 is inputted; and a duty 100% signal generating circuit 33B for generating a duty 100% signal via the triangle wave generating circuit 38 and the (proportion+integration) circuit. FIG. 22 indicates one example of a duty 100% signal. That is to say, when a DC voltage of the power source voltage is gradually lowered, the duty 100% signal gradually appears, and finally this signal becomes a perfect duty ratio of 100%. As a result, when the duty 100% signal in established, it is judged that it becomes a duty ratio 100%. To cancel the duty 100% signal. the speed command of the fan motor is corrected along the lowering direction.

As a result, it is always under rotational speed control state, so that the above-described problem can be solved. Even when it becomes a duty ratio of 100%, if the fan motor is not rotated at a high speed, since the back electromotive force is large and no overcurrent flows for variations in the power source voltage, the duty ratio of 100% operation process may be performed depending upon the rotational speeds.

A process for judging a choking phenomenon in a filter will now be described. Although the choking phenomenon of the filter can be judged based upon values of static pressure, since the static pressure nay change even when the air suction port is in contact with the cleaning floor surface, there are some possibilities of erroneous judgement. To this end, the choking phenomenon of the filter may be judged by utilizing a magnitude of $H/N^2$ based upon the general fluid theory of the fan motor. When the filter is choked, since the air quantity supplied from the air suction port is lowered, cooling performance of the fan motor is deteriorated. As a result, the motor may be overheated, whereby the control state of the vacuum cleaner is changed from the fuzzy control state to the waiting operation state in order that power supplied to the motor is reduced so as to suppress overheating of the motor. A process for judging a closed suction port will now be described. When the suction port is closed, the air quantity is furthermore lowered as compared weight the air quantity when the filter is choked. When the suction port is completely closed, the an air quantity becomes zero. At this time, since the motor is quickly overheated, the correct judgement of the closing of the suction port is required. As shown in FIG. 14, as the judging method for the closed air suction port, since the motor is driven at a constant rotational speed under the choked filter state or the substantially completely closed suction port state, the value of the air quantity may affect the load conditions. Thus, since the load current becomes small in accordance with a decreasing of the air quantity, namely reducing the load, it is so judged that the suction port is completely closed when the load current continuously becomes smaller than a certain set value for more than a setting time period. Then, the operation of the vacuum cleaner is stopped, and this state is displayed on the display circuit provided at the side of the main body. In case of a vacuum cleaner, if a plug socket of the vacuum cleaner is pulled out from a receptacle by an operator and the vacuum cleaner is newly started, the same judgement as described above is repeated, so that overheating of the motor may not be prevented. As a result, to prevent such problems, the setting time period is varied depending upon the magnitudes of the load current of the motor. In other words, as the load current becomes small, the setting time period is reduced.

Furthermore, a process of self-diagnostic operation will now be explained. Since a vacuum cleaner is a necessity of life, if operation of the vacuum cleaner is interrupted due to the protection function of the control circuit, it is required to quickly recover the operation of the vacuum cleaner.

Figure 24A:
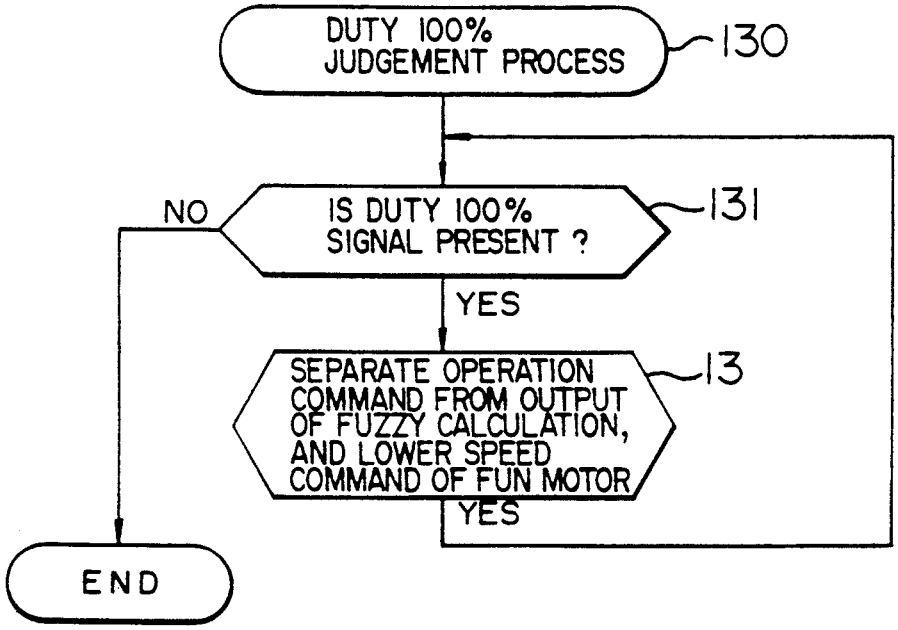
FIGS. 24A and 24B are flow charts for explaining a process of a duty ratio of 100% judgement and a process of a self diagnostic operation.
Figure 24B:
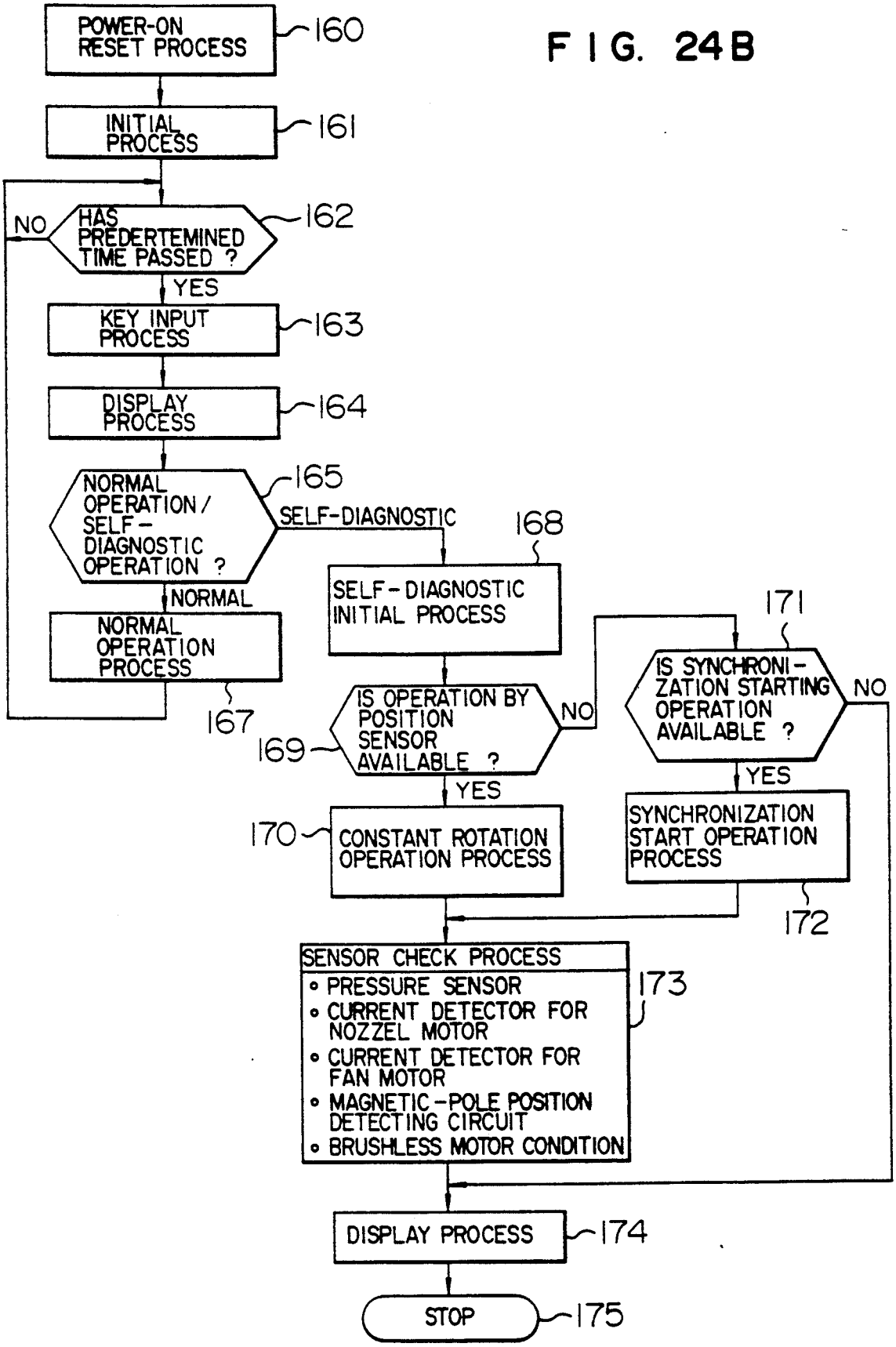

It is difficult for a serviceman to quickly specify a malfunction with correctness, since the control circuit is so complicated according to the preferred embodiment. This function may be arrived at by the self diagnostic operation. In this preferred embodiment, a switch for the self diagnostic operation is employed (this switch is provided with either the handle circuit, or the control circuit in the main body, otherwise may be provided with both circuit). When this switch is depressed, this switch depression is sensed so that the vacuum cleaner is brought into the self diagnostic operation. In FIG. 24B, there is shown one example of a low chart for explaining the self-diagnostic operation. In this figure, when the power source plug (not shown) of the vacuum cleaner is inserted into a plug socket (not shown) of the power source, the execution of the program is commenced from a power-on reset process (160).

After the power-ON reset process according to the program, an initial process (161) for initializing either registers on memories employed in the microcomputer and a main routine process is command.

In the main routine, initiation is performed every predetermined time period, a key input process (163) and a display process (164) are executed, and either the normal operation or the self-diagnostic operation (165) is selected in response to the key operations effected in the handle circuit. In case of the normal operation, the normal operation process is carried out and the process is returned to the step after the initial process. When the self-diagnostic operation is selected, the memories and registers employed in the microcomputer are initialized (108) for the self-diagnostic purpose. A judgement is made whether or not the operation by way of the position sensor is possible (169). If the operation by the position sensor is possible, a process for constant rotation operation is performed to drive the motor at low speed. At this time, a diagnostic operation is carried out to check whether or not the respective sensors, i.e., pressure sensors, the current detecting circuit of the nozzle motor, and the current detecting circuit of the fan motor are malfunctioning, or extraordinary. Also, a judgement is made whether or not the fan motor is demagnetized based on the output for the current detecting circuit of the fan motor (sensor check process) (173) . Then, the result of the sensor check process is displayed and the motor is stopped (174).

To the contrary, in case that the operation by way of the position sensor is not possible, another check is made whether or not synchronization starting operation is available (171). When the synchronization starting operation is possible, a process for the synchronization starting operation is carried out so that the motor is driven at low speed. Similarly a sensor check process whether or not the magnetic pole position detecting circuit is operated under normal condition (172). Conversely, when the synchronization starting operation is not available, a display that both the constant rotation operation and the synchronization starting operation by the position sensor are impossible is made and the process is ended (174).

As a consequence, since both the constant rotation operation mode and the synchronization starting operation mode are combined with each other in the self-diagnostic operation mode, a check whether or not the respective sensors are operated under normal condition can be performed, and also it is possible to specify whether the malfunction part is in the circuit board of the main circuit of the control circuit, the circuit board of the microcomputer, the circuit board of the handle circuit, or the circuit board of the sensors, or at the motor side. As a result, the location of the malfunction can be quickly and correctly specified.

A content of the control/process for the microcomputer 19 will now be explained with reference to mainly FIG. 1.

Step 1: When the operation switch 30 is turned ON, both a process for fetching an operation command and an initiation process (process 7) are executed whereby the rotational speed of the fan motor FM is raised up to the minimum rotational speed.

Step 2: In response to the signal 18S derived from the magnetic pole position detecting circuit 18, the rotational speed "N" is calculated (process 1). Upon receipt of the signal 31S from the static pressure detecting circuit 31, the static pressure detecting process (process 13) is carried out so as to detect the static pressure "H". Then, the air quantity "Q" is calculated based on the rotational speed "N", static pressure "H" and the current instruction I * of the fan motor FM (corresponding to the load current otherwise the detection value of the current of the fan motor may be utilized) (Q data).

Step 3: After the initiation process, the process is advanced to the writing operation mode, so that the vacuum cleaner is operated under control for constant rotational speed, or control for constant air capacity, depending upon the choked filter. Since the operation mode is the waiting operation mode, the gain of the pressure sensor is increased (process 15).

Step 4: Upon receipt of the signal from the zerocross detecting circuit 32, the instantaneous voltage is applied to the nozzle motor 26, and upon receipt of the signal 24S from the nozzle motor current detecting circuit 24, a process (process 2) for detecting the current of the nozzle motor is performed. In the suction port judgement (process 14), if the nozzle motor current is sensed, it is so judged that the power brush suction port has been mounted. Conversely, if no nozzle motor current is sensed, it is so judged that the suction port other than the power brush suction port has been mounted.

Step 5: As a result of the suction port judgement, if the power brush suction port has been mounted, the operation mode is the waiting operation mode, so that the phase control angle for the nozzle motor is set in such a manner that the rotational speed of the rotary brush 10 becomes 300 to 500 r.p.m. based upon the signal from the zerocross detecting circuit 32. The reason why the rotational speed of the rotary brush 10 is set to 300 to 500 r.p.m., namely the low speed, is to mit useless power during the waiting operation, and also to give such an indication to the operator and other persons who are located near the operator, that the rotary brush 10 is rotated.

Step 6: The process for detecting the choking state of the filter is carried out based upon the rotationship between the static pressure and the rotational speed, so as to detect the choking degree of the filter. The detection result is displayed on the display circuit provided at the main body of the vacuum cleaner.

Step 7: A previously described with reference to FIGS. 20A and 20B, in the static pressure detecting process (process 13), if the variation $\Delta H$ in the static pressure in the positive direction is detected, the judgement is performed that the vacuum cleaner is under cleaning operation (process 6) and then the control is advanced to the fuzzy control, whereas if the variation in the static pressure is not detected, then the waiting operation is continued. When the control is advanced to the fuzzy control, the signal is sent to the static pressure detecting circuit in response to the signal 31C, and the gain of the pressure sensor is decreased (process 15).

Step 8: When the control is moved to the fuzzy control, both the variation width $\Delta pbi$ in the current peak value of the nozzle motor and the variation width $\Delta H$ in the static pressure are detected in the process for detecting the variation width (process 4).

Step 9: If the power brush suction port is used in the suction port judgement (process 14), the fuzzy calculation is selected where the variation width $\Delta pbi$ is employed as the input. To the contrary, if the suction port other than the power brush suction port is employed, the fuzzy calculation is selected in which the variation width $\Delta H$ is inputted.

Step 10: The fuzzy calculation unit 19A is constructed of a fuzzy calculation unit for producing the air-capacity instruction $\theta$cmd and a fuzzy calculation unit for producing the static pressure instruction Hcmd. In case of the power brush suction port, both the fuzzy calculation unit having the variation width $\Delta pbi$ and the air-capacity instruction Q and as the input thereof, and also the fuzzy calculation unit having the variation width $\Delta pbi$ and the static pressure instruction Hcmd as the input are selected. In case of the suction port other than the power brush suction port, both the fuzzy calculation unit having the variation width $\Delta H$ and the air capacity instruction Qcmd as the inputs thereof, and the fuzzy calculation unit having the variation width $\Delta H$ and the state pressure instruction Hcmd as the inputs thereof are selected. A new air capacity instruction Qcmd and a new static pressure instruction Hcmd are produced from the fuzzy calculation results.

Step 11: The selection between the fuzzy calculation unit having the air-quantity instruction Qcmd an the input, and the fuzzy calculation unit having the static pressure instruction Hcmd as the input, is carried out either in the constant air-quantity control region, or the constant static pressure control region.

Step 12: The selection among the constant air-quantity control (Q:constant), the constant static pressure control (H:constant), and the constant rotational-speed control (N:constant) is carried out in the operation mode setting process (process 16) in accordance with the magnitudes of the air-quantity instruction Qcmd (otherwise, air-quantity calculation value Q data) and the static pressure H.

Step 13: The nozzle motor 26 is driven via an ignition signal process (process 9) by determining the phase control angle in the phase control angle setting process (process 8) in which the result of the fuzzy calculation and the output from the zerocross detecting circuit 32 are used as the inputs.

Step 14: Under either the constant air-quantity Q control or the constant static-pressure H control, the speed instruction N * is outputted by adjusting the static pressure command Hcmd with the static pressure detection value H data, or the air-capacity command Qcmd with the air capacity calculation value Q data.

Step 15: Then, upon receipt of the signal 23S of the fan motor current detecting circuit 23, the fan motor current detecting process (process 3) is performed so as to detect the load current $I_D$. In response to this load current $I_D'$ the rotational speed N (process 1) and the speed instruction N *, a current instruction I * is outputted from the speed control process (ASR) and current control process (ACR). Upon receipt of this current instruction I *, the base driver signal 19D is outputted in the ignition signal generating process (process 10). In response to the base driver signal 19S, the fan motor FM control the rotational speed to a derived rotational speed.

As a consequence, since the rotational speeds of the fan motor FM and the nozzle motor 26 are adjusted or controlled based on the magnitudes of the variable width Δpbi ($V_{MB}$) of the peak value in the nozzle motor current and the variation width ΔH ($H_{MB}$) of the static pressure, the optimum suction forces can be obtained, depending upon the sorts of the cleaning floor planes.

As the extraordinary processes in the respective processes as shown in FIG. 1, there are the process for judging the locking state of the power brush (pb) (process 14); the process for judging instantaneous interruption of the power source (process 20); the process for judging a duty ratio of 100% (process 14); and also the process for judging the tightly closed air suction port (process 21). It should be noted that these extraordinary processes are utilized at the vacuum cleaner, if the motor control systems are contained in the extraordinary processes, overdrive process and overcurrent process, though not shown in the drawings. The process for judging the locking state of the power brush (pb) is to select the static pressure variation width ΔH as the variation width even when the power brush suction port is employed as previously described with reference to FIG. 10.

Although, it is not shown in FIG. 10, in the case where the locking state of the power brush (pb) is detected, the gain of the pressure sensor, which is utilized when the air-quantity command value and the static-pressure command value are determined from a result of the fuzzy calculation with the variation width of the static pressure as the input, may be increased so as to obtain optimum suction force in accordance with the floor surface.

The duty 100% judgement process will now be explained with reference to a flowchart shown in FIG. 24A. This judgement is established by checking whether or not the output is derived from the duty 100% judging circuit as previously described with reference to FIG. 21 (131). That is, when the output of the duty 100% judging circuit is detected, the rotation speed of the fan motor is reduced. If the output is not detected, this process is ended.

Figure 25A:
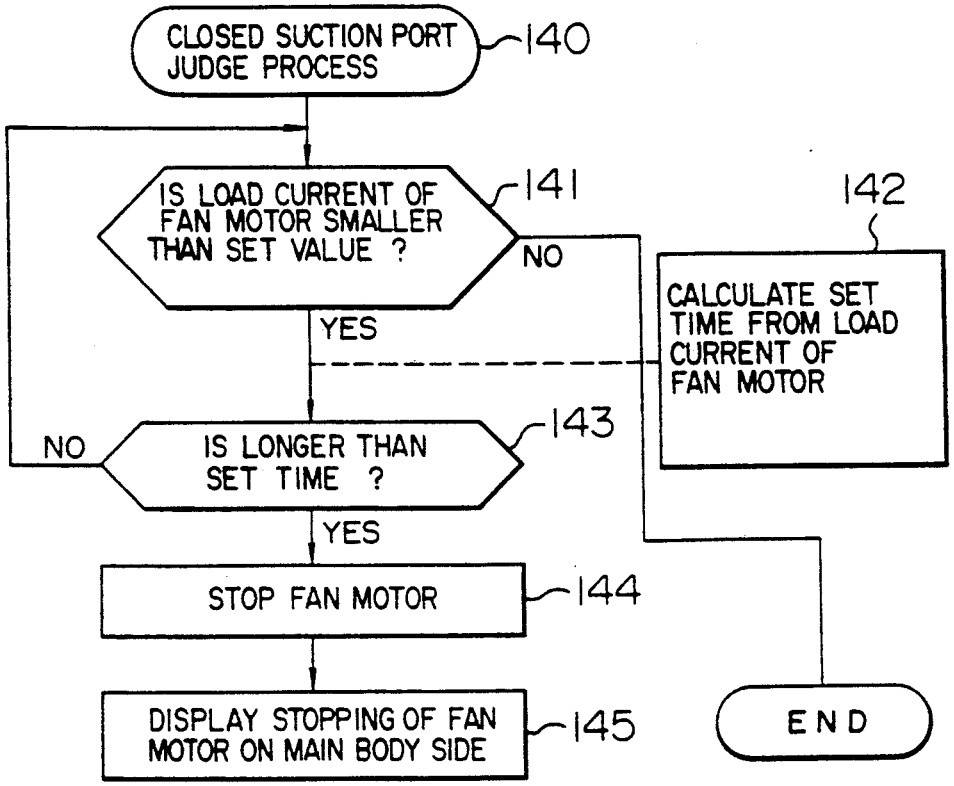
FIGS. 25A and 25B are flow charts for explaining a process for judging a tightly closed suction port and a process for judging a instantaneous power source interruption.

The process for judging the tightly closed suction port will now be explained with reference to a flowchart shown in FIG. 25A. In accordance with this judgement, a first check in made as to whether or not the load current of the fan motor is smaller than a preset value (141). If this condition is continued for a time period longer than a predetermined time period (judgement result of 143 becomes YES), then it is judged that the air suction port is tightly closed. It should be noted that as previously stated, when an operator pulls the plug socket to drive again the vacuum cleaner from the initial condition, the same judgement is repeated. To avoid such a repetition, the setting time is lowered in accordance with a decrease in the load current (142).

Figure 25B:
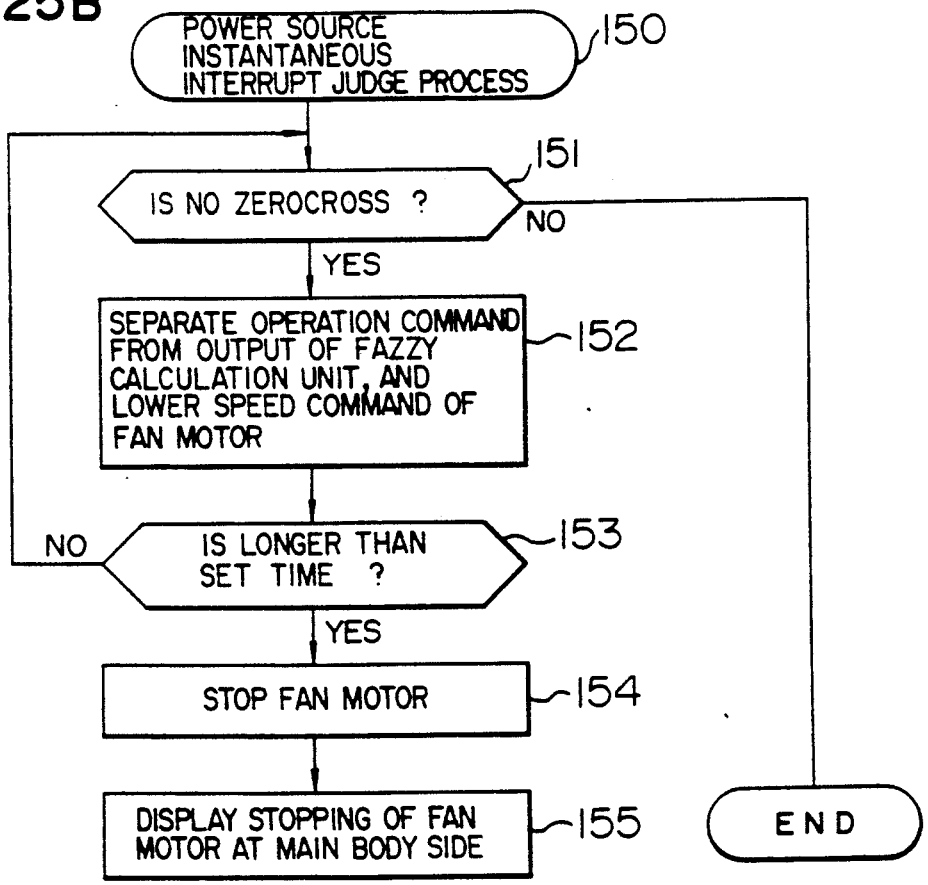

With respect to the process for judging the instantaneous power source interruption, a description will now be made by referring to a flow chart shown in FIG. 25B. The instantaneous interruption of the power source is judged by checking whether or not there is a zerocross signal during a half cycle of the frequency of this power source by way of the zerocross detecting circuit, as described with reference to FIG. 5 (151). If no zerocross signal appears, it is judged that the power source is instantaneously interrupted, and thus the rotation instruction of the fan motor is lowered (152). If this condition is furthermore continued for more than a preset time period (judgement result of 153 is YES), it is so judged that the power source is interrupted whereby the fan motor is stopped (154), which will be displayed on the display circuit (155).

A control/process content of the microcomputer 19 shown in FIG. 1 according to another preferred embodiment of the present invention will now be described with reference to FIG. 27. It should be noted that the same reference numerals will be employed for denoting the same or similar controls shown in FIG. 1, and explanations thereof are omitted.

Step 1: substantially the same as the step 1 of the previous embodiment shown in FIG. 1.

Step 2: substantially the same as the step 2 of the previous embodiment shown in FIG. 1.

Step 3: substantially the same as the step 4 shown in FIG. 1.

Step 4: The choked filter detecting process (process 5) is performed based upon the relationship between the air-quantity Q and the static pressure H, whereby the choking degree of the filter is detected.

Step 5: In the suction port judgement (process 14), if the power brush suction port is used, the nozzle motor 26 is driven (at low speed) via the zerocross detecting circuit 32, the phase control angle setting process (process 8) and the ignition signal process (process 9), and also the variation width Δpbi in the peak value of the current of the nozzle motor and the variation width ΔH($H_{MB}$) of the static pressure when the suction port is operated, are detected by the variation width detecting process (process 4).

Step 6: substantially the same as the step 10 shown in FIG. 1.

Step 7: Depending upon the magnitudes of the air-quantity command Qcmd and the static pressure command Hcmd, a selection is made from the constant air-quantity Q control, the constant static-pressure H control, and the constant rotational speed N control. The speed instruction N * is outputted by adjusting the detected value H data of the static pressure with the calculated value Q data of the air-quantity under the respective controls.

Step 8: substantially the same as the step 15 shown in FIG. 1.

Step 9: At the same time, based on the results obtained from the fuzzy calculation unit 19A, an ignition angle is determined by the phase control angle switching process (process 8) in response to the zerocross detecting circuit 32, the ignition signal 19D of FLS 25 of the nozzle motor 26 is outputted via the ignition signal generating process (process 9), and then the rotational speed of the nozzle motor 26 is controlled with linking to the fan motor FM.

Next, a vacuum cleaner according to a further preferred embodiment of the present invention will be explained with reference to FIGS. 28, 29 and 30.

Figure 28:
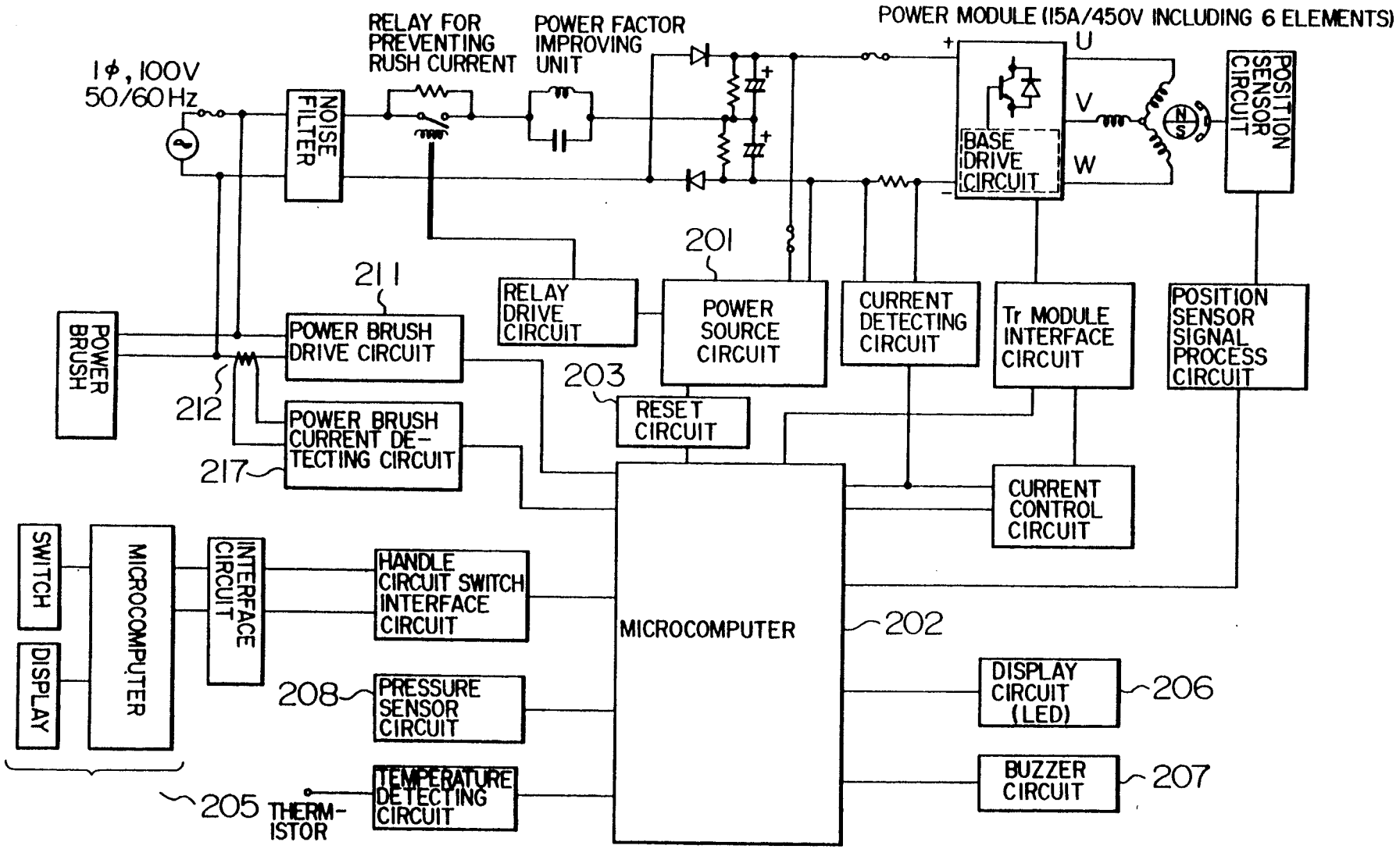
FIG. 28 is a schematic block diagram for representing a control circuit employed in a vacuum cleaner according to a further preferred embodiment of the present invention.
Figure 29:
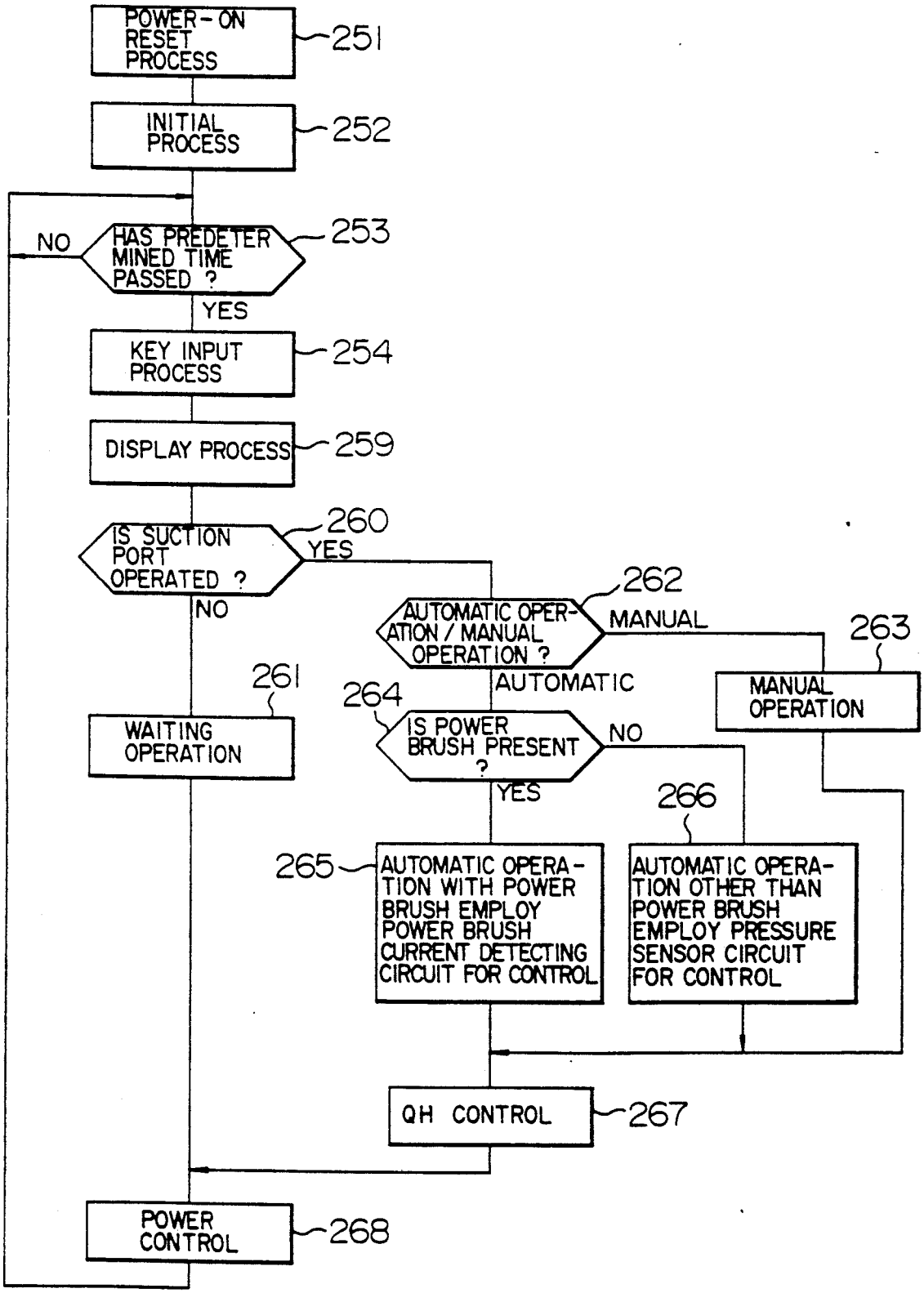
FIG. 29 is a flow chart for explaining a program of a microcomputer employed in the control circuit of the vacuum cleaner shown in FIG. 28.

FIG. 28 represents a schematic block diagram for showing an arrangement of a control circuit according to this preferred embodiment. FIG. 29 is a flow chart for explaining a program of a microcomputer 202 employed in the control circuit shown in FIG. 28.

Operations of the vacuum cleaner according to this preferred embodiment of the present invention will now be sequentially described with reference to FIGS. 28 and 29.

First, when a power supply plug (not shown in detail) of this vacuum cleaner is inserted into a power supply socket (not shown), a power source circuit 20 employed within the control circuit is energized, and this control circuit is brought into the active state. The program shown in FIG. 29, starts to be executed from a power-ON reset process when the power source of the microcomputer 202 is turned ON and a reset signal is supplied from a reset circuit 203 to this microcomputer.

After the power-ON reset process (251), an initial process (252) for initializing registers and memories employed in the microcomputer is performed and a main routine process is commenced in accordance with the program.

The main routine is assembled to be initialized every predetermined time period (253).

Then, the content of the main routine process will be sequentially explained. A key input process 254 is so performed that when a switch for controlling the vacuum cleaner, provided is a hose handle circuit 205, is depressed by an operator, a signal corresponding to the depressed switch is transmitted from the hose handle circuit 205 to the main body, this signal is received and processed.

A display process 259 is such a process to drive circuits 206, 207 arranged by LED or buzzer.

Next, while the vacuum cleaner is under operation, a check is made whether or not an operator manipulates the air suction port of the vacuum cleaner, namely the air suction port is relatively moved with respect to the cleaning surface (260). This is achieved in such a way that the pressure within the main body of the vacuum cleaner detected by a pressure sensor circuit 208 shown in FIG. 28 is monitored, and when the variation in the pressure within a predetermined sampling time is higher than a certain value, the air suction port is operated by the user. In other words, when the user operates the vacuum cleaner and moves the suction port over the cleaning plane, the pressure within the vacuum cleaner's main body is changed by variations in the depression force of the reciprocated suction port against the cleaning surface. On the other hand, even when the vacuum cleaner is operated, if the suction port is suspended in the air, or is maintained on the cleaning surface, the above-described pressure change does not occur. Therefore, it is possible to judge whether or not the suction port is manipulated by continuously monitoring the pressure within the main body of this vacuum cleaner so as to calculate this variation. As a consequence, when the air suction port is under an operation state ("YES" of step 260), the suction force of the vacuum cleaner is increased and the rotational speed of the rotary brush for the suction port is simultaneously increased. When either the suction port is under the stationary condition, or is suspended in the air ("NO" of step 260), the suction force of the vacuum cleaner is reduced and also the rotational speed of the rotary brush for the suction port is lowered, whereby the operation condition is under the waiting condition (261), and therefore power consumption is saved and noise levels are lowered. During the waiting operation, the rotation of the rotary brush for the suction port may be stopped.

As previously stated, the judgement whether or not the air suction port is under use is performed by checking the variations in the static pressure executed in the main body of the vacuum cleaner, whereby the operation condition of the vacuum cleaner can be subdivided into the waiting operation and the normaloperation.

Although the method for discriminating the operations of the suction port by checking whether or not the variations in the static pressure are present has been described in the above-described method, this method has the following difficulty. That is, in this case, when the vacuum cleaner is brought into the waiting operation condition due to no variation in the static pressure, if the suction port is lifted up from the flow plane under such a condition that the suction port is stationarily maintained on the cleaning surface, the above described variations occur in the static pressure, so that the power of the vacuum clearer is increased and the operation condition thereof is moved to the normal operation. In the above-described case, it is not preferable to increase the power of the vacuum cleaner from the waiting condition to the normal condition, but it is desirable to maintain the waiting operation. To this end, as a variation condition of the static pressure within the main body of the vacuum cleaner in case that the operation condition thereof is changed from the waiting operation to the normal operation (i.e., power up), this power up operation may be performed only when the variations in the static pressure are in the reduction direction (i.e., the direction to increase a degree of vacuum). That is to say, in such a case that the suction port is moved from the contact condition with the cleaning floor surface into the suspended condition, the static pressure within the main body of the vacuum cleaner is in an increasing direction (degree of vacuum is lowered). This phenomenon where the static pressure is increased is ignored, and discrimination is made whether or not the suction port is manipulated with employment of only the variations in the reduced static pressure, so that the control with better utility for the vacuum cleaner can be realized.

Thereafter, when the process passes through the above-described judgement and is advanced to the normal operation, as represented in the flow chart, the further process is branched (262), depending upon either the "automatic" operation, or the "manual" operation instructed by operating the keys provided at the hose handle. In case of the "manual" operation, the motor employed in the main body of the vacuum cleaner is driven under the constant strong operation. On the other hand, when the "automatic" operation is instructed and the operation mode is advanced to the "automatic" operation, a process (264) for judging whether or not the power brush is employed is carried out so as to judge whether the suction port connected to the vacuum cleaner, corresponds to a suction port including a rotary brush actuated by a motor (will be simply referred to as the "power brush"), or other brush.

In accordance with the process 264 for judging whether or not the power brush is used, a bidirectional thyristor included in the power brush drive circuit 211 and for phase-controlling the power brush is ignited, and a current flowing through a current line of the power brush is detected by a current transformer 12. If the power brush is connected, the current flows through the current transformer 212 which detects this current and produces an output voltage. To the contrary, if the suction port other than the power brush is connected to the vacuum cleaner, the above-described current does not flow and thus no output is derived from the current transformer. As a result, it is possible to judge whether or not the power brush is connected to the vacuum cleaner. It should be noted that the process for judging whether or not the power brush is employed is valid only when the switch for the power brush employed at the hose handle portion to drive the power switch is turned ON. Conversely, when the power switch is turned OFF, this judging process is not executed.

Passing through the above-described process for judging whether or not the power brush is used, the process of the automatic operation is branched into the following two processes.

A first process is an automatic operation 265 while using the power brush. In this process, the vacuum cleaner is controlled based upon variations in the current of the nozzle motor. That is to say, when the power brush is utilized, the current of the nozzle motor for driving the rotary brush is varied because of load variations in the rotary brush when the power brush is pushed and pulled on the cleaning surface while reciprocating the power brush, and also load variations in the rotary brush caused by changing depression force of the power brush against the cleaning surface. In particular, attention is given to differences in the variation widths of the load currents with respect to the cleaning surfaces, for example, a flat floor, a tatami mat, a carpet and the like, and therefor both the motor employed in the main body of the vacuum cleaner and the motor for driving the rotary brush are controlled based upon the differences. In other words, when the flat floor is cleaned, the load current of the rotary brush and the variation width thereof are small. In case of the flat floor, since there are fewer dirty articles on the floor surface and thus a dirty article may be readily sucked up by a small suction air capacity, the rotational speed of the fan motor employed in the main body of the vacuum cleaner is reduced and also the rotational speed of the rotary brush is lowered. On the other hand, when a carpet is being cleaned, the resistance given to the rotary brush becomes large, the load current of the rotary brush driving motor becomes great, and further the variation width thereof becomes large. When the carpet is cleaned, since dust or dirty articles mixed with this carpet are sucked up and also these articles entered into the carpet are sucked up, the rotational speed of the fan motor employed in the main body of the vacuum cleaner is increased so as to power up the suction-force, and also the rotational speed of the rotary brush is increased, whereby the dust or dirty articles present in the carpet are effectively removed.

Subsequently, the second process is an automatic operation 266 when a suction port other than the power brush is utilized. In this case, the motor of the main body of the vacuum cleaner is controlled based upon not the variations in the current of the nozzle motor, but the variation width in the pressure within the main body of the vacuum cleaner. As the control method, when the above-described variation width in the pressure is small, the rotational speed of the fan motor employed in the main body of the vacuum cleaner is lowered, whereas when the pressure variation width is conversely large, the rotational speed of the fan motor employed is the main body of the vacuum cleaner is increased. As a consequence, such a control can be realized that while cleaning a floor by using the floor suction port, the above described pressure variation width is small and the suction force of the vacuum cleaner also becomes small, whereas while the suction port having a narrow tip portion, for the opening is used during the cleaning operation, the pressure variation width becomes large and the suction force of the cleaning force is increased.

Passing through the above-described automatic operation process, the process is entered into a QH control process 267. The automatic operation according to the present invention is expressed in FIG. 3) by way of a graphic representation between static pressure (degree of vacuum) and a suction air quantity, which is generally utilized so as to represent a suction characteristic of a vacuum cleaner. The suction characteristic is subdivided into a control for constant air capacity, a control for constant pressure, and a choked filter operation.

The constant air-capacity control is an operation to compensate for lowering of the air capacity caused by the choked filter of the vacuum cleaner and to maintain a constant suction air capacity. The constant pressure (static pressure) operation is an operation to suppress the static pressure (degree of vacuum) to a constant value in order to prevent difficult cleaning operations such as that when the suction port is in excessively close contact with the cleaning surface, during which the static pressure (degree of vacuum) is increased. Then, the choked filter operation is such an operation to lower the rotational speed of the motor employed in the main body of the vacuum cleaner when the filter is choked and thus the air capacity is lowered, in order to avoid overheat of this motor.

Figure 30:
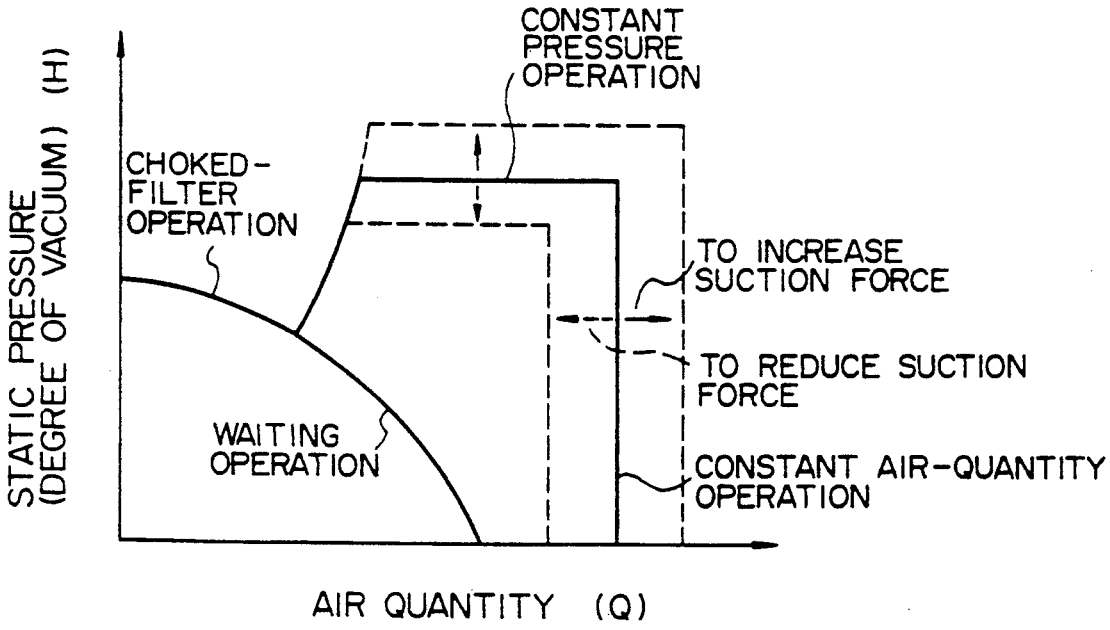
FIG. 30 represents a drive mode for the vacuum cleaner shown in FIG. 28.

When the suction force of the vacuum cleaner is increased, such a process for increasing a constant air-capacity value and also a constant pressure value is performed as indicated by an arrow of a solid line shown in FIG. 30, in response to the output of the above-described automatic operation process. Conversely, when the suction force is reduced, a process for lowering the constant air-capacity value and the constant pressure value is employed, as represented by an arrow of a dot line. As to the choked filter operation, no change is made.

Finally, a power control process 268 is executed. The content of this control process is as follows. The current of the motor employed in the main body of the vacuum cleaner is detected by the current detecting circuit 217 provided in the block diagram of FIG. 28, whereby a protection is realized so as to prevent such a problem that the current value excessively becomes large and thus input power to the motor excessively becomes large.

After accomplishing the above-described process, the process operation is again returned to the key input process 254 and this loop is repeated.

It should be noted that although the DC brushless motor was used as the motor employed in the main body of the vacuum cleaner in the above-described preferred embodiment of the present invention, as shown in FIG. 28, a commutator motor which has been widely employed in the conventional vacuum cleaner may be alternatively utilized.

Another preferred embodiment of the present invention in which a fan motor is controlled by calculating an air quantity based on an output of an air-pressure sensor employed in the vacuum cleaner of the present invention, will now be explained with reference to FIGS. 31 to 38.

Figure 31:
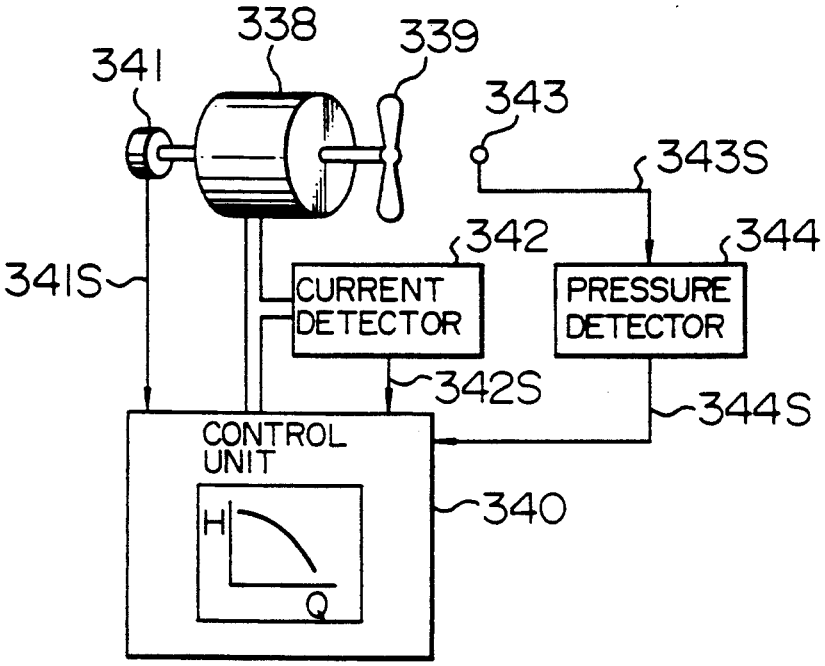
FIG. 31 schematically illustrates a construction of a fan motor according to one preferred embodiment of the present invention.

FIG. 31 represents a schematic arrangement of a fan motor according to one preferred embodiment of the present invention. The fan motor is constructed of a variable speed motor 338 and a fan 339. In a control apparatus 340, a signal 341S from a speed detector 341, a signal 342S from a current detector 342, and a signal 343S from a pressure sensor 343 are received as a signal 344S from a pressure detector 344 whereby both a rotational speed and a load current of the fan motor are detected. The control apparatus for controlling velocities of the variable speed motor 338 calculates various factors indicative of load conditions, for instance, an air capacity "Q" based on the rotational speed, load current and pressure, and also drives the fan motor based on this calculation result.

In accordance with this preferred embodiment, an example where a brushless motor has been employed as the fan motor (i.e., variable speed motor) of the vacuum cleaner will now be explained.

Furthermore, according to the present invention, a value of air capacity representative of load conditions of the vacuum cleaner is employed as the various factors indicative of the load conditions of the fan motor.

Figure 32:
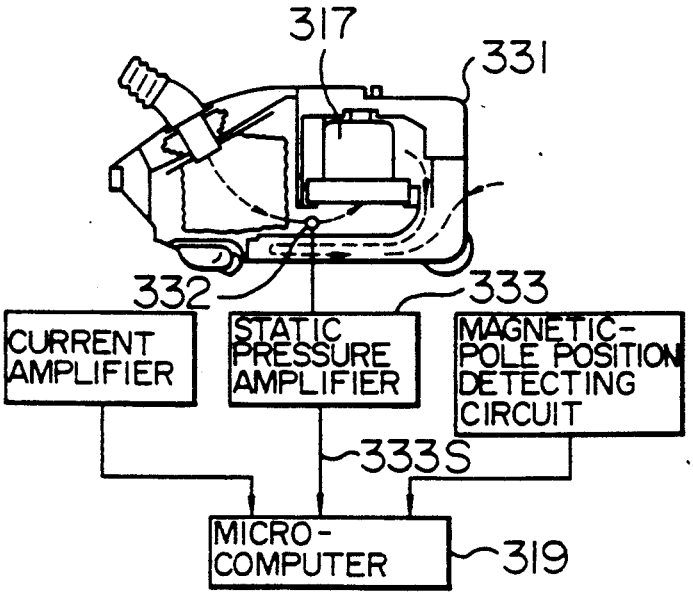
FIG. 32 schematically represents a construction of a vacuum cleaner according to one preferred embodiment of the present invention.
Figure 33:
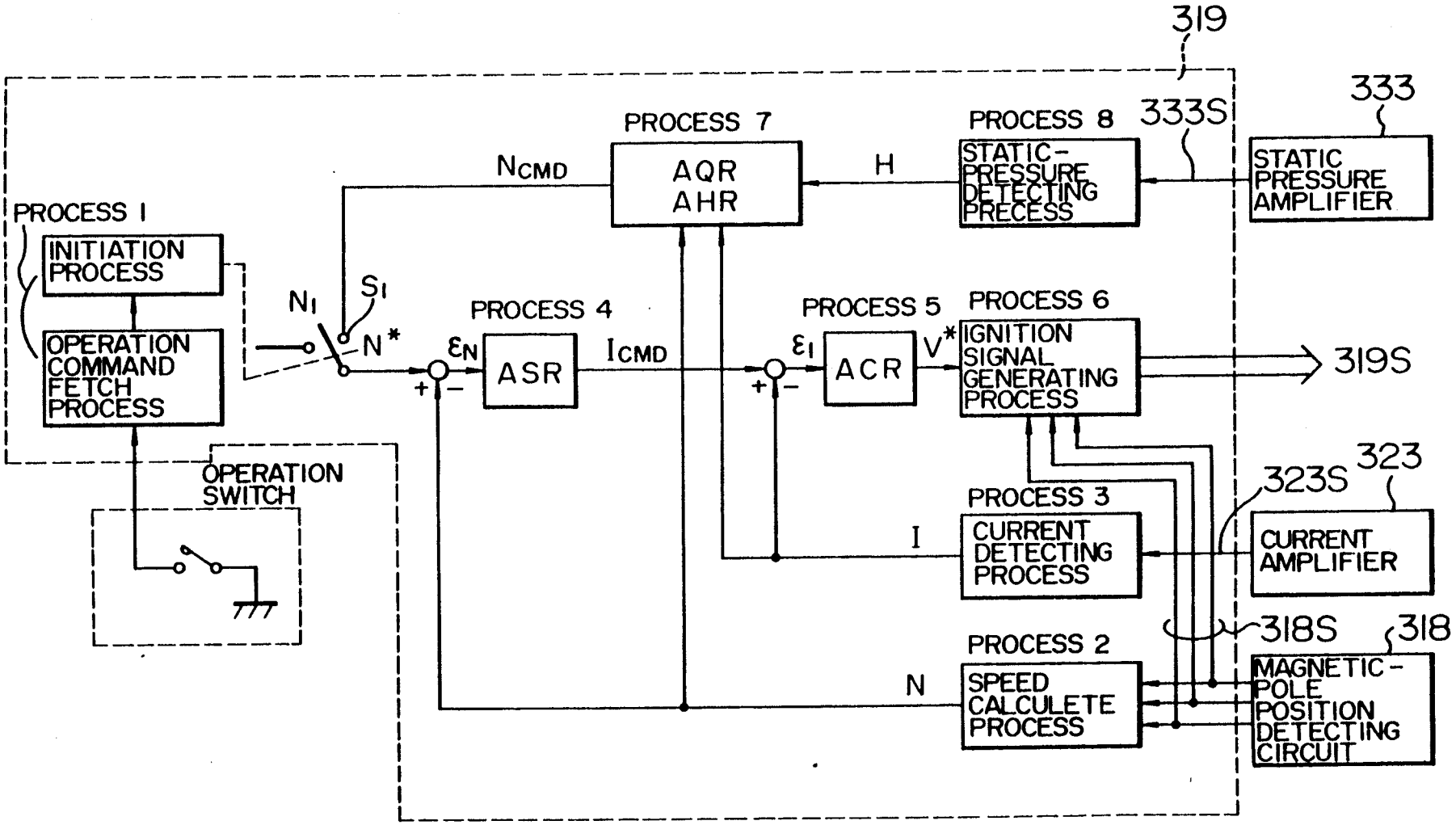
FIG. 33 is a schematic block diagram for showing an arrangement of a control circuit for a brushless motor used in a vacuum cleaner according to one preferred embodiment of the present invention.
Figure 34:
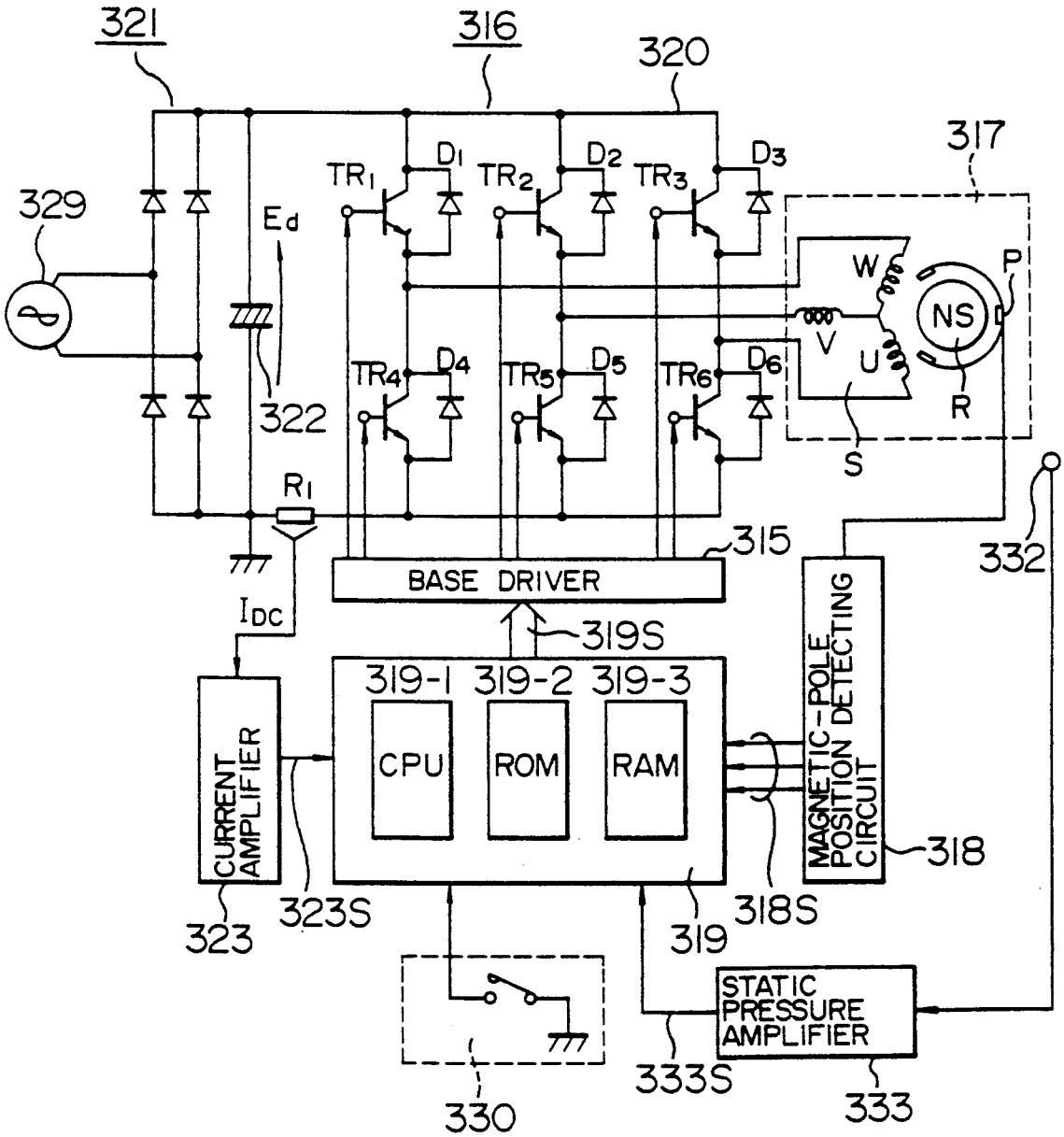
FIG. 34 is a schematic diagram for showing an entire arrangement of a control circuit for a brushless motor used in a vacuum cleaner according to one preferred embodiment of the present invention.

FIG. 32 schematically represents a construction of the vacuum cleaner, FIG. 33 is a schematic block diagram showing an arrangement of a control circuit, and FIG. 34 is a circuit diagram showing an entire arrangement of the control circuit.

In the drawings, reference numeral 331 indicates a main body of the vacuum cleaner, and reference numeral 316 is an inverter apparatus for driving a brushless motor 317 in a variable speed mode. Reference numeral 329 indicates an AC power supply. An AC voltage of this AC power supply 329 is rectified by a rectifier circuit and then smoothened by a capacitor 322, so that a DC voltage Ed is applied to an inverter circuit 320. The inverter circuit 320 is of a 120-degree conduction type inverter constructed of transistors $TR_1$ to $TR_6$, and also circulating diodes $D_1$ to $D_6$ which are connected in parallel to the respective transistors $TR_1$ to $TR_6$. The transistors $TR_1$ to TR3 constitute a positive arm, whereas the transistors $TR_4$ to $TR_6$ constitute a negative arm. The respective conduction periods of the negative arm are pulse-width-controlled (PWM) at 120 degrees of electric angle. Symbol "$R_1$" denotes a resistor having a relatively low resistance value, which is connected between the emitter sides of the transistors $TR_4$ to $TR_6$ for constituting the negative arm and the minus side of the capacitor 322.

A brushless motor 317 is constructed of rotors "R" made of two-pole permanent magnets and armature wires (windings) U, V and W. Load currents $I_{DC}$ flowing through these wires or windings U, V, W are detectable as voltage drops across the resistor $R_1$.

A speed control circuit of the brushless motor 317 is mainly arranged by a magnetic-pole position detecting circuit 318 for detecting the magnetic pole positions of the rotors R by way of a Hall effect element "PS" and the like; a current amplifier 323 for amplifying detected values of the above-explained load currents $I_{DC}$ (since the voltage drop across the resistor $R_1$ is caused by a DC current which is different from the load current of the brushless motor 317, the voltage drop value of this resistor $R_1$ is amplified and the load current of the brushless motor 317 is simulated by a peak hold circuit with a discharge circuit); a base driver 315 for driving the transistors $TR_1$ to $TR_6$; and a microcomputer 319 for operating the base driver 315 based upon the magnetic-pole-position detecting signal 318S obtained from the magnetic-pole-position detecting circuit 318. Reference numeral 333 denotes a static pressure amplifier for amplifying a detection value of a static pressure sensor 332 for detecting pressure (static pressure) of the vacuum cleaner, and a static pressure signal 333S is processed in the microcomputer 319. Reference numeral 330 denotes an operation switch actually operated by a user.

As previously stated, the magnetic-pole position detecting circuit 318 produces the magnetic-pole position detecting signal 318S of the rotors "R" in response to the signal from the Hall effect element "PS". This magnetic-pole position detecting signal 318S is used not only to change currents of the armature windings U, V, W, but also as the signal for detecting the rotational speed.

The microcomputer 319 operates to obtain the rotational speed by counting the number of the magnetic-pole position detecting signals 318S within a constant sampling period.

The microcomputer 319 includes a central processing unit (CPU) 319-1, a read-only memory (ROM) 319-2, and a random access memory (RAM) 319-3, which are mutually connected to each other via address buses and data buses although not shown. Then, in ROM 319-2, a program required for driving the brushless motor 317 has been stored, for instance, a calculation process of velocities, a fetch process of operation command, a speed control process (ASR), a current control process (ACR), and a current detection process and the like.

On the other hand, RAM 319-3 is employed so as to read/write various external data required to execute the various programs which have been stored.

The transistors $TR_1$ to $TR_6$ are driven by the base driver 315 ignition signals 319S which have been processed and produced in the microcomputer 319.

In such a kind of brushless motor 317, since the currents flowing through the armature windings U, V, W correspond to output torque of the motor, this output torque is variable by changing the supply currents, conversely. In other words, the output of the motor can be continuously and arbitrarily changed by controlling the supply currents. The rotational speed of the motor may be arbitrarily varied by changing the operation frequency of the inverter.

Figure 35:
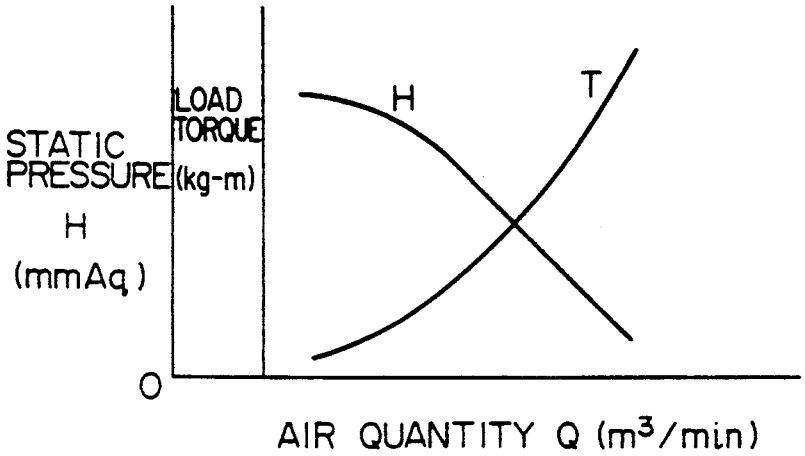
FIG. 35 is a Q-H characteristic diagram of the vacuum cleaner according to the present invention.

The vacuum cleaner according to the present invention employs such a brushless motor 317. FIG. 35 represents a Q-H characteristic of the vacuum cleaner with employment of the brushless motor, where an abscissa indicates an air capacity "Q" and an ordinate denotes static pressure and load torque "T" of a fan (fan of electric air blower).

In FIG. 35, Q-H characteristic of the vacuum cleaner, when the rotational speed of the motor is set constant, the static pressure H becomes large in case of the small air capacity Q, whereas the static pressure H becomes small in case of the large air capacity Q. The load torque T of the fan is represented as a square curve, and this load torque T is also changed by the conditions of the air suction port (variations in areas into which air is blown), although not shown in the figure.

In accordance with this preferred embodiment with respect to such a Q-H characteristic of the vacuum cleaner, the following means have been executed in order to calculate the air quantity from the load conditions of the brushless motor 317 without employing the air-quantity sensor.

First, an output P(W) of the brushless motor is expressed by the following formula:

$$P=1.027\times N\times T(W) \quad \text{(formula 3)},$$

where symbol "N" indicates the rotational speed (rpm) and symbol "T" represents torque (kg—m).

Based on the above formula 3, the torque "T" is given by:

$$T=\frac{P}{1.027\times N} \quad \text{(formula 4)}$$

In the formula 4, the output "P" is obtained by:

$$P=Eo\cdot I \quad \text{(formula 5)}$$

and $$E_o=K_o\cdot N \quad \text{(formula 6)},$$

where symbol "$E_o$" indicates an induced voltage (V), symbol "Ko" represents a coefficient of the induced voltage, and symbol "I" denotes a load current (A).

The torque "T" is obtained based on the above-described formulae 4, 5 and 6 as follows:

$$\begin{aligned} T &= \frac{E_oI}{1.027\times N} \\ &= K_oI \end{aligned} \quad \text{(formula 7)}$$

That is to say, the torque "T" is directly proportional to the motor current I.

In accordance with a similarity rule for a general fluid, the following relationships are known:

$$L\propto N^3\cdot D^5 \quad \text{(formula 8)}$$

$$Q\propto N\cdot D^3 \quad \text{(formula 9)}$$

$$H\propto N^2\cdot D^2 \quad \text{(formula 10)},$$

where symbol "L" denotes a shaft input (W) of a fan; symbol "Q" represents an air quantity (m3/min); symbol "H" indicates static pressure (mm Aq); symbol "N" is a rotational speed (r.p.m); and symbol "D" represents a diameter (mm) of a vane. Since the fan is directly coupled to the motor, it may be conceived that the shaft input "L" and rotational speed "N" of the fan are equal to the output "P" and rotational speed of the motor, and therefore the formula 8 is modified based upon the formulae 9 and 10:

$$P\propto Q\cdot H \quad \text{(formula 11)}$$

It should be noted that the output "P" of the motor is expressed by the above-described formulae 5 and 6 as follows;

$$P=K_o\cdot I\cdot N \quad \text{(formula 12)}$$

As a result, the above-described formula 11 may be expressed based on the formula 12 as follows:

$$Q\propto\frac{I\cdot N}{H} \quad \text{(formula 13)}$$

Furthermore, the air quantity "Q" may be indicated by the following formula (14) based on the above-described formulae 13, 10, and 11:

$$Q\propto\frac{I}{H} \quad \text{(formula 14)}$$

It should also be noted that although various error factors such as the efficiency of air blower, the efficiency of motor, air leakages from the main body of the vacuum cleaner, and variations in unit volume/weight of air caused by temperatures may be considered, these error factors are ignored for the sake of simplicity.

Figure 36:
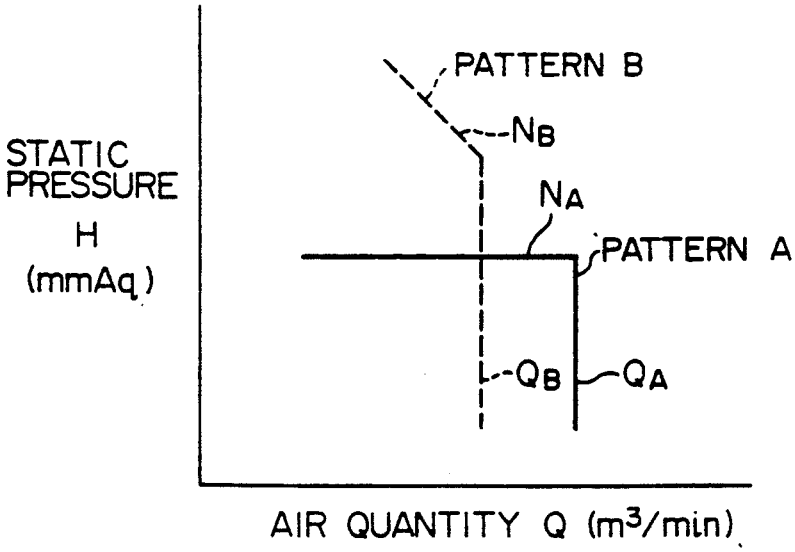
FIG. 36 is a diagram for representing a typical operating pattern of the vacuum cleaner according to the present invention.

FIG. 36 represents typical operation patterns (pattern "A" and pattern "B") of a vacuum cleaner. In the Q-H characteristic of this drawing, according to the pattern "A", a constant $Q_A$ control is performed at the side of the large air quantity and a constant $H_A$ control is carried out at an air quantity lower than the air quantity $Q_A$. According to this pattern "B", a constant $Q_B$ control is performed at an air quantity $Q_B$ smaller than the air quantity $Q_A$, and a constant speed control having a constant rotational speed $N_B$ is performed at an air quantity lower than the air quantity $Q_B$.

The pattern "A" is designed for a tatami mat to be cleaned, in which the rotational speed is reduced at the air quantity higher than the large air quantity $Q_A$, and the motor input is reduced so as to maintain the air quantity $Q_A$ constant. Also, the constant static pressure $H_A$ control is performed at the air quantity lower than the large quantity $Q_A$ in order not to scratch a surface of a tatami mat.

The pattern "B" is designed for a carpet to be cleaned, in which the constant air-quantity $Q_B$ control is performed, when the rotational speed reaches the maximum speed $N_B$ and also the air quantity is below $Q_B$, a constant rotational speed $N_B$ control is executed, whereby maximum power for the vacuum cleaner is obtained.

Then, concrete control means will now be explained based upon the formulae 5 and 8.

When an operator actually operates the drive switch 330, the microcomputer 319 executes as a process 1, both a process for fetching an operation command and an initiation process, and drives the brushless motor 1 up to a predetermined rotational speed $N_1$. During the initiation, the changing switch $S_1$ is switched to select the speed instruction $N_1$, and upon completion of the initiation, the output $N_{CMD}$ of AQR and AGR of the process 7 is selected.

When the speed instruction $N_1$ is determined during the initiation, the microcomputer 19 receives the magnetic-pole position detection signal 18S fran the magnetic-pole position detection circuit 18 to execute the ignition signal generating process of the process 6, thereby determining the elements of the transistors $TR_1$ to $TR_6$ to be ignited. Then, the speed calculation process of the process 2 is performed so as to calculate the actual speed "N" of the brushless motor 317, In the current detecting process of the process 3, the load current I of the brushless motor 317 is detected upon receipt of the signal 323S from the current amplifier 323.

In accordance with ASR of the process 4, the current command $I_{CMD}$ is obtained from deviation $\epsilon_N$ between the speed instruction N, and the actual speed N, whereas in accordance with ASR of the process 5, the voltage instruction V* is calculated from deviation $\epsilon_I$, between the current command $I_{CMD}$ and the load current I.

Upon receipt of the voltage command V, and the magnetic-pole position detecting signal 318S, the ignition signal generating process of the process 6 determines the elements of the transistors $TR_1$ to $TR_6$ to be ignited, and also outputs the ignition signal 319S which has been pulse width-modulated in order to vary the applied voltage.

When the brushless motor 317 reaches the predetermined rotational speed $N_1$, the change switch $S_1$ is switched into the output signal $N_{CMD}$ of AQR and ΔHR of the process 7.

To achieve a predetermined air quantity Q and preselected static pressure H, for example, the patterns A and B shown in FIG. 36, AQR (a quantity adjuster) and ΔHR (static pressure adjuster) of the process 7 output the speed command $N_{CMD}$ from the actual speed N and load current I.

The brushless motor 317 is so controlled by determining the voltage command V* via ASR and ACR of the processes 4 and 5 in such a manner that the rotational speed N becomes not an external command, but an internal command.

As previously described, in accordance with this preferred embodiment, the suction power of the vacuum cleaner can be controlled to become an optimum value in such a manner that the brushless motor is employed as the drive source for the vacuum cleaner, the air quantity or capacity "Q" is calculated from the load current I, rotational speed N and static pressure H of the motor without utilizing the air capacity sensor, and also the constant air-quantity control (AQR) and the constant static-pressure control (ΔHR) are performed in accordance with the operation patterns.

Although the air quantity "Q" has been calculated from the load current, rotational speed and static pressure of the brushless motor in this preferred embodiment, the air quantity "Q" may be obtained by calculating a ratio of the current command to the rotational speed.

Figure 37:
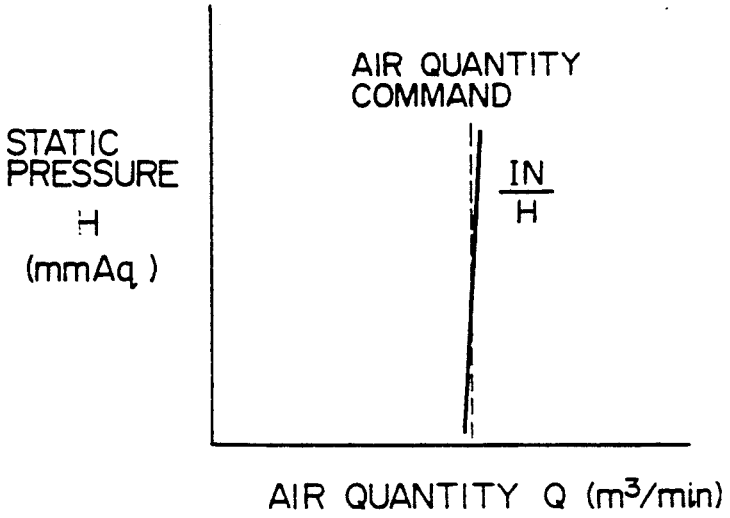
FIG. 37 represents experimental data indicative of relationships between air capacity and current command X rotational speed/static pressure; and, FIG. 38 indicates experimental data representative of a relationship between air capacity and (current command/rotational speed + current command X rotational speed/static pressure)/2.

The experiment data of FIG. 37 indicates operation of the vacuum cleaner by the air quantity and static pressure. The air quantity "Q" may be obtained from a ratio of the static pressure to a product between the current command and rotational speed, and the stable constant air-quantity control may be realized based on the air quantity command.

Figure 38:
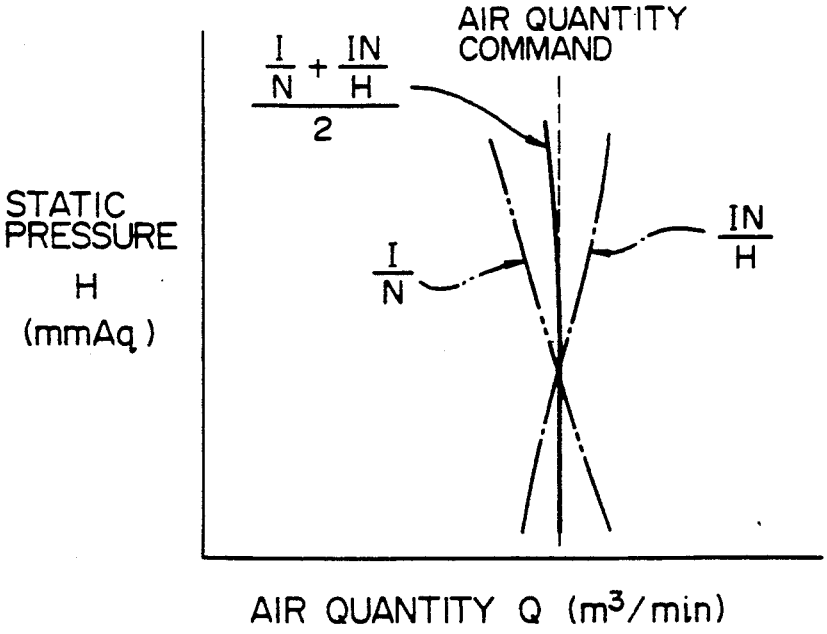

Also, the experiment data of FIG. 38 indicates operation of the vacuum cleaner by an air capacity and static pressure. Comparing a method (I/N) for obtaining an air capacity "Q" of a ratio of the current command "I" and the rotational speed "N", with a method (IN/H) for obtaining an air capacity "Q" of a ratio of the product between the current command I and the rotational speed N to the static pressure H, the I/N method is moved in such a direction that the air capacity becomes small when the static pressure becomes high. Conversely, the I·N/H method is moved in each a direction that the air capacity becomes large when the static pressure becomes high. Based upon the relationship between both of these methods, namely the above-described formulae 13 and 14, the following formula 15 is conducted:

$$Q \propto \frac{(I/N) + (IN/H)}{2} \qquad \text{(formula 15)}$$

It is possible to calculate the air capacity with better precision by way of the method for averaging the formula 15. It should be noted that although in accordance with this preferred embodiment, both the formula 13 and formula 14 are averaged, alternatively a ratio thereof may be employed.

In this embodiment, the air quantity "Q" and the static pressure H are utilized for motor control, also, they may be used for indication of state of the vacuum cleaner.

Furthermore, although the brushless motor was employed as the fan motor of the vacuum cleaner in the preferred embodiment, an AC commutator motor may be alternatively utilized as this fan motor.

Figure 27:
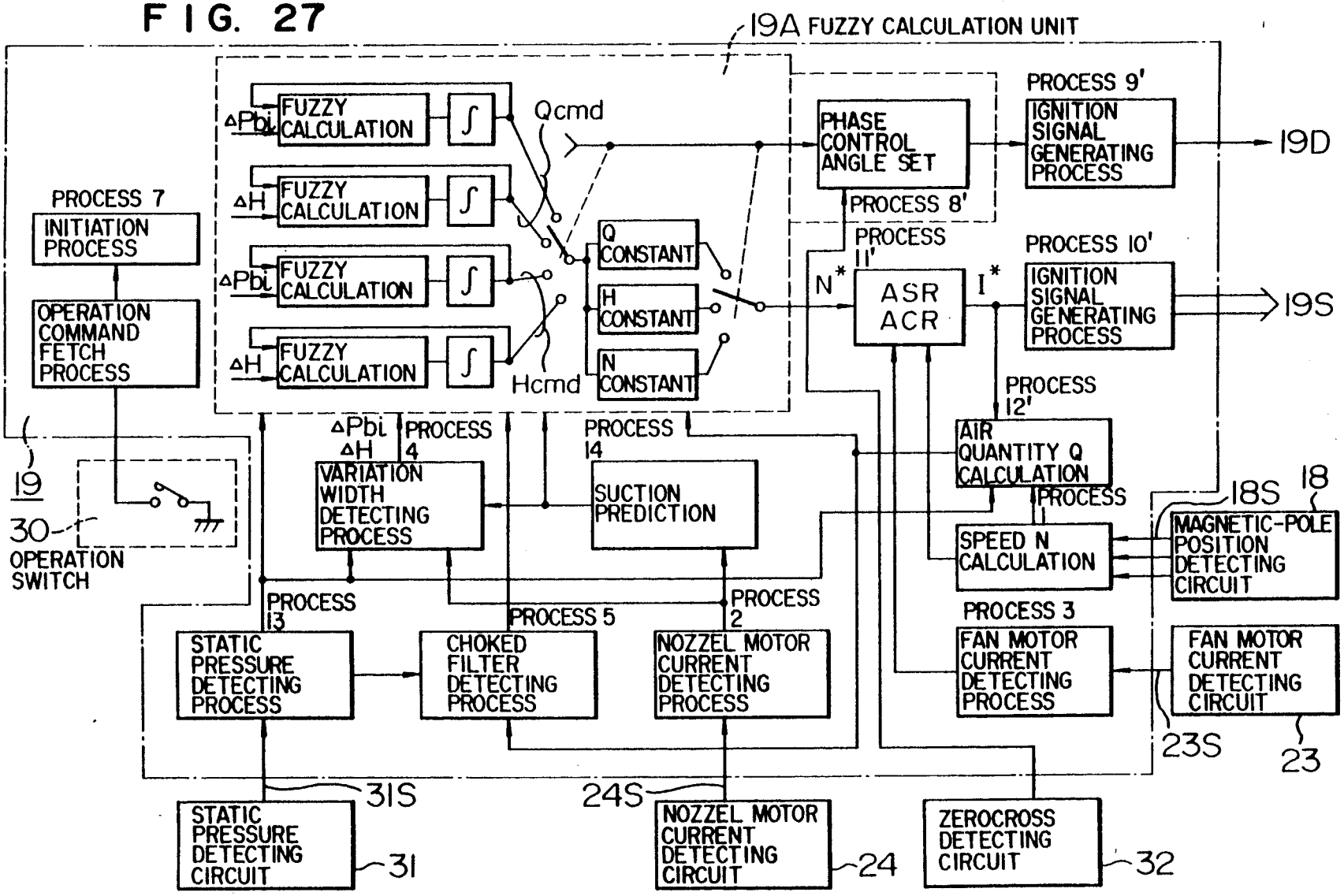
FIG. 27 is a schematic block diagram for showing an overall control circuit employed in another vacuum cleaner according to another preferred embodiment of the present invention.

The mechanism, according to the preferred embodiment, in which the air capacity is calculated based upon the output from the air pressure sensor, may be preferably utilized in the previously explained preferred embodiment as shown in FIG. 1, 27 or 30.

Furthermore, this mechanism may be applied not only to vacuum cleaners, but also to fan motors used for electric fans and cooling blowers.

While particular embodiments of the present invention have been shown and described, it will be obvious to those skilled in the art that various changes and modifications may be made without departing from the present invention in its broader aspects.

We claim:

1. A vacuum cleaner comprising:

a main body case having an air inlet;

a filter in said main body case for collecting dust;

a variable-speed fan motor in said main body case for producing an air flow from said air inlet through said filter to generate a suction force at said air inlet;

a pressure sensor for sensing a choking phenomenon of said filter, which sensor is disposed in said air flow within said main body case;

a rotational speed sensor for sensing the rotational speed of the fan motor;

a load current sensor for sensing the load current of the fan motor;

a nozzle coupled to said air inlet and having an air suction port, a rotary brush mounted therein and a nozzle motor for driving said rotary brush;

a circuit for detecting a current of the nozzle motor to drive the rotary brush, said circuit being incorporated in said air suction port of said nozzle; and control means including first means for detecting static pressure from an output of said pressure sensor; second means for calculating a quantity of air flowing through said air suction port using values selected from the rotational speed and load current of the fan motor sensed by said rotational speed sensor and said load current sensor, respectively, and the said static pressure detected by said first means; third means for adjusting the rotational speed of said fan motor based upon an air-quantity command value and a static pressure command value in relation to the quantity of the air and the static pressure at said air suction port and based on said static pressure detection value and said air-quantity calculation value; fourth means for detecting a variation width of a peak value of a current of said nozzle motor and a variation width of said static pressure varying at said air suction port during a cleaning operation; fifth means for performing a fuzzy calculation using at least two inputs selected from said air-quantity command value, said variation width of the peak value of the current of said nozzle motor, said static pressure command value, said variation width of the peak value of the current of said nozzle motor, and said variation width of the static pressure; and sixth means for determining said air-quantity command value and static pressure command value based on a result of said fuzzy calculation.

2. A vacuum cleaner as claimed in claim 1, wherein said fuzzy calculation performed by said fifth means is executed, using said two inputs, by inputting said air-quantity command value feedback from said output of said sixth means and said variation width of the peak value of the current of said nozzle motor to generate said air-quantity command value, by inputting said air-quantity command value feedback from an output of said sixth means and said variation width of said static pressure, by inputting said static pressure command value feedback from an output of said sixth means and said variation width of the peak value of the current of said nozzle motor to generate said static pressure command value, and also by inputting said static pressure command value feedback from an output of said sixth means and said variation width of said static pressure to generate said static pressure command value.

3. A vacuum cleaner as claimed in claim 2, wherein said fifth means includes means for selecting four types of fuzzy calculation in accordance with whether or not said nozzle motor is used and also the magnitude of said static pressure.

4. A vacuum cleaner as claimed in claim 1, wherein the input of said fuzzy calculation is said air-quantity calculation value.

5. A vacuum cleaner as claimed in claim 1, wherein the input of said fuzzy calculation is said static pressure detection value.

6. A vacuum cleaner as claimed in claim 1, wherein said results of the fuzzy calculation are produced by said sixth means using integration, and both said air-quantity command value and said static pressure command value are determined based upon the integration result.

7. A vacuum cleaner as claimed in claim 1, wherein a phase control angle of said nozzle motor is determined based upon the result of the fuzzy calculation performed by said fifth means.

8. A vacuum cleaner as claimed in claim 1, wherein the results of the fuzzy calculation are produced by said fifth means using integration, both said air-quantity command value and said static pressure command value produced by said sixth means are determined based on the integration value, and both said air-quantity command value and said static pressure command value are in a stepwise form with respect to the inputs of the variation width of the peak current value of the nozzle motor and also said static pressure variation width.

9. A method for controlling a vacuum cleaner including a main body case including an inlet and a filter for collecting dust; a variable speed fan motor in said main body case for producing an air flow from said air inlet through said filter; a pressure sensor provided within the air flow in said main body case for sensing a choking phenomenon of the filter; a rotational speed sensor for sensing a rotational speed of the fan motor; a load current sensor for sensing a load current of the fan motor; a nozzle coupled to said air inlet and having a brush, a nozzle motor for driving said brush and an air suction port at which a suction force is generated by said air flow; a circuit for detecting a current of said nozzle motor; and a control circuit for controlling the fan motor, comprising the steps of:

detecting static pressure at an output from said pressure sensor, and calculating a quantity of air flowing from said air suction port with employment of values selected from a rotation speed of said fan motor, a load current of said fan motor, and said static pressure;

detecting a variation width of the peak current value of said nozzle motor and a variation width of the static pressure varying with operation of said suction port during a cleaning operation, executing a fuzzy calculation with at least two inputs selected from an air-quantity command value, a static pressure command value, said variation width of the peak current value of said nozzle motor and also said variation width of the static pressure; and determining said air-quantity command value and said static pressure command value based upon the result of said fuzzy calculation; and controlling the rotational speed of said fan motor in accordance with the air-quantity command value and the static pressure command value which are related to a quantity of the air and static pressure at said air suction port, and also said static pressure detection value and said air-quantity calculation value.

10. A vacuum cleaner comprising:

a main body case having an air inlet;

a filter in said main body case for collecting dust;

a variable-speed fan motor in said main body case for producing an air flow from said air inlet through said filter to generate a suction force at said air inlet;

a pressure sensor for sensing a choking phenomenon of said filter, which sensor is disposed in said air flow within said main body case;

a rotational speed sensor for sensing the rotational speed of the fan motor;

a load current sensor or sensing the load current of the fan motor;

a nozzle coupled to said air inlet and having an air suction port, a rotary brush mounted therein and a nozzle motor for driving said rotary brush;

a circuit for detecting a current of the nozzle motor to drive the rotary brush, said circuit being incorporated in said air suction port of said nozzle; and control means including first means for detecting static pressure from an output of said pressure sensor; second means for calculating a quantity of air flowing through said air suction port using values selected from the rotational speed and load current of the fan motor sensed by said rotational speed sensor and said load current sensor, respectively, and the detected static pressure; third means for adjusting the rotational speed of said fan motor based upon an air-quantity command value and a static pressure command value in relation to the quantity of the air and static pressure at said air suction port and based on said static pressure detection value and said air-quantity calculation value; fourth means for detecting a variation in the width of a peak value of current of said nozzle motor and a variation in the width of said static pressure varying with operation of said suction port during a cleaning operation; fifth means for performing a fuzzy calculation using at least two inputs selected from said air-quantity command value, said variation width of the peak value of the current of said nozzle motor, said static pressure command value, and said variation width of the static pressure; sixth means for determining said air-quantity command value and static pressure command value based on a result of said fuzzy calculation; and seventh means for detecting a locking state of said rotary brush from the current value of said nozzle motor and for employing a result of the fuzzy calculation with said variation of the static pressure to more precisely obtain said air-quantity command value and static pressure command value.

11. A vacuum cleaner as claimed in claim 10, wherein both said air-quantity command value and said static pressure command value determined by said sixth means are determined from a result of the fuzzy calculation performed by said fifth means with the variation in the width of the static pressure as an input, and further including means for controlling the gain of said pressure sensor when said command values are determined based on a judgement result of the locking state of said rotary brush.

12. A vacuum cleaner as claimed in claim 10, wherein the input of said fuzzy calculation performed by said fifth means is said air-quantity calculation value.

13. A vacuum cleaner as claimed in claim 10, wherein the input of said fuzzy calculation is said static pressure detection value.

14. A method for controlling a vacuum cleaner including a main body case including an inlet and a filter for collecting dust; a variable speed fan motor in said main body case for producing an air flow from said air inlet through said filter; a pressure sensor provided within the air flow in said main body case for sensing a choking phenomenon of the filter; a rotational speed sensor for sensing a rotational speed of the fan motor; a load current sensor for sensing a load current of the fan motor; a nozzle coupled to said air inlet and having a brush, a nozzle motor for driving said brush and an air suction port at which a suction force is generated by said air flow; a circuit for detecting a current of said nozzle motor; and a control circuit for controlling the fan motor, comprising the steps of:

rotating said fan motor at a low rotational speed as a waiting operation by first executing an initiation process of said fan motor upon turning on an operation switch of said vacuum cleaner;

detecting operation conditions of said suction port from changes in the output from said pressure sensor;

increasing the power to said fan motor to be ready for a cleaning operation under the operation state of said suction port;

detecting a static pressure from the output of said pressure sensor;

calculating a quantity of air flowing from said air suction port using values selected from the rotational speed and the load current of said fan motor, and said static pressure;

controlling the rotational speed of the fan motor, depending upon an air-quantity command value and a static pressure command value, which are related to the quantity of the air and static pressure at said suction port, and said static pressure detection value and said air quantity calculation value;

detecting a variation in the width of the peak current value of said nozzle motor and a variation in the width of the static pressure which depending upon operation of said suction port during a cleaning operation;

executing a fuzzy calculation with at least two inputs selected from said air-quantity command value, said static pressure command value, said variation in the width of the peak current value of said nozzle motor and said variation in the width of the static pressure; and determining said air-quantity command value and said static pressure command value based upon the result of said fuzzy calculation.

15. A method for controlling a vacuum cleaner as claimed in claim 14, wherein when a judgement is made that the result of detecting the operation condition of said suction port is not under the operation condition, a speed command of said fan motor is set to said waiting operation state.

16. A method for controlling a vacuum cleaner as claimed in claim 14, wherein a gain of said pressure sensor under said waiting operation state is increased with respect to the operation state employing the result of said fuzzy calculation.

* * * * *